US007066744B2

(12) United States Patent
Kameyama et al.

(10) Patent No.: US 7,066,744 B2
(45) Date of Patent: Jun. 27, 2006

(54) ELECTRICAL CONNECTOR

(75) Inventors: Isao Kameyama, Shizuoka (JP); Takashi Toi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/820,131

(22) Filed: Apr. 8, 2004

(65) Prior Publication Data

US 2004/0203269 A1 Oct. 14, 2004

(30) Foreign Application Priority Data

Apr. 9, 2003 (JP) ..... 2003-105819
Oct. 27, 2003 (JP) ..... 2003-365642

(51) Int. Cl.
*H01R 13/648* (2006.01)

(52) U.S. Cl. ..... 439/108; 439/610

(58) Field of Classification Search ..... 439/101, 439/108, 92, 497, 610
See application file for complete search history.

(56) References Cited

U.S. PATENT DOCUMENTS 4,850,887 A * 7/1989 Sugawara ..... 439/108
5,145,387 A * 9/1992 Ichihashi ..... 439/108
5,224,867 A * 7/1993 Ohtsuki et al. ..... 439/108
5,525,067 A * 6/1996 Gatti ..... 439/108
6,146,157 A * 11/2000 Lenoir et al. ..... 439/101
6,287,132 B1 * 9/2001 Perino et al. ..... 439/108
6,641,411 B1 * 11/2003 Stoddard et al. ..... 439/108
6,692,272 B1 * 2/2004 Lemke et al. ..... 439/108
6,736,676 B1 * 5/2004 Zhang et al. ..... 439/607
6,767,252 B1 * 7/2004 McGrath et al. ..... 439/637

FOREIGN PATENT DOCUMENTS

JP 2002-334748 11/2002

* cited by examiner

*Primary Examiner*—Gary F. Paumen
(74) *Attorney, Agent, or Firm*—Finnegan, Henderson, Farabow, Garrett & Dunner, L.L.P.

(57) ABSTRACT

An electrical connector has a housing accommodating a plus signal terminal and a minus signal terminal. The connector housing also accommodates a first ground terminal corresponding to the plus signal terminal and a second ground terminal corresponding to the minus signal terminal. Each of the plus signal terminal, the minus signal terminal, the first ground terminal, and the second ground terminal is positioned at each corner of a quadrangle. A distance between the plus signal terminal and the first ground terminal is shorter than a distance between the minus signal terminal and the first ground terminal, while a distance between the minus signal terminal and the second ground terminal is shorter than a distance between the plus signal terminal and the second ground terminal. The connector may have a retainer body received in the connector housing for retaining the plus signal terminal, the minus signal terminal, the first ground terminal, and the second ground terminal. The four terminals are embedded in the retainer body each at an intermediate portion of the terminal.

16 Claims, 17 Drawing Sheets

ELECTRICAL CONNECTOR

BACKGROUND OF THE INVENTION

1. Field of the Invention

The present invention relates to an electrical connector having a plus signal terminal, a minus signal terminal, and a ground terminal, particularly to an electrical connector for transmitting differential signals at a high speed.

2. Related Art

An automobile vehicle is equipped with electronic instruments such as a navigation system. The navigation system has a main unit for calculating a present position of the vehicle and a display for indicating the present position and a destination position of the vehicle. This type of display requires high resolution and needs to indicate the present position in real time.

Signals supplied from the main unit to the display tend to increase in quantity. Therefore, various types of high-speed signal transmission processes have been applied to such navigation systems. There are a single end type (unbalanced type) and a differential type (balanced type) in conventional signal transmission processes.

The single end type has a single signal lead and a ground lead for recognizing "HIGH" and "LOW" of digital signals by a potential difference between the leads, which has been used generally.

Meanwhile, the differential signal type uses two signal (plus and minus) leads for recognizing "HIGH" and "LOW" of digital signals by a potential difference between the leads. Each signal of the two leads is equal to each other in voltage but, offset by 180 degrees in phase from each other. The differential signal type can cancel noises generated by the two leads at a receiver side to allow a high speed signal transmission as compared with the single end type.

To achieve high-speed transmission of differential signals, Japanese Patent Application Laid-open No. 2002-334748 discloses connectors like ones shown in FIGS. 38, 39. A connector 101 or 102 has a plus signal terminal, a minus signal terminal, and a ground terminal.

The connector 101 shown in FIG. 38 has a housing 109, a plus signal terminal 103, a minus signal terminal 104, and a ground terminal 105. Each of the terminals 103, 104, and 105 is positioned at each corner of an isosceles triangle.

The connector 102 shown in FIG. 39 has a housing 110, a plus signal terminal 106, a minus signal terminal 107, and a ground terminal 108. Each of terminals 106, 107, and 108 is formed in a metal plate having a rectangular section with a comparatively larger thickness. The ground terminal 108 has a width larger than those of the plus signal terminal 106 and the minus signal terminal 107.

In the connector 102 shown in FIG. 39, the plus signal terminal 106 and the minus signal terminal 107 are positioned to be spaced from the ground terminal 108 in parallel with the ground terminal 108 along a longitudinal direction of the terminals.

The connector 101 or 102 shown in FIG. 38 or 39 has the single ground terminal 105 or 108 that cooperates with the plus signal terminal 103 or 106 and the minus signal terminal 104 or 107 for signal transmission.

The navigation system mounted in the vehicle preferably has a plurality of the displays which are arranged each in a front seat or in rear seat. Thus, a cable connecting the main unit to the display for high-speed differential signal transmission may become longer. Meanwhile, a connector for the high-speed transmission needs to achieve a less signal loss.

In the conventional connector 101 or 102, a current flow for signal transmission in the plus signal terminal 103 or 106 generates an induction current in the ground terminal 105 or 108. In turn, the induction current generates another induction current in the minus signal terminal 104 or 107 since the ground terminal 108 corresponds to both the plus and minus terminals.

Furthermore, a current flow for signal transmission in the minus signal terminal 104 or 107 generates another induction current in the ground terminal 105 or 108. These induction currents have an adverse effect to each other, causing an increased loss in signal transmission.

SUMMARY OF THE INVENTION

In view of the disadvantage of the conventional art, an object of the invention is to provide a connector that can decrease a transmission loss in signal for a high-speed differential signal transmission process.

To achieve the object, an aspect of the invention is an electrical connector having a housing accommodating a plus signal terminal and a minus signal terminal, the connector comprising:

a first ground terminal corresponding to the plus signal terminal and a second ground terminal corresponding to the minus signal terminal, the first and second ground terminals accommodated in the housing.

A current flow in the plus signal terminal generates an induction current in the first ground terminal, and a current flow in the minus signal terminal generates an induction current in the second ground terminal. The first ground terminal is separated from the second ground terminal.

Thus, a current flow in the plus signal terminal generates an induction current neither in the minus signal terminal nor in the second ground terminal, while a current flow in the minus signal terminal generates an induction current neither in the plus signal terminal nor in the first ground terminal. This prevents a noise (current) generated in the plus and minus terminals, limiting a signal transmission loss in the terminals.

Preferably, each of the plus signal terminal, the minus signal terminal, the first ground terminal, and the second ground terminal is positioned at each corner of a quadrangle in a transverse section of the connector. This allows minimization in size of the connector.

Preferably, the connector includes a plurality of terminal sets each having the plus signal terminal, the minus signal terminal, the first ground terminal, and the second ground terminal. This increases transmission signals in quantity.

Preferably, in a transverse section of the connector, the plus signal terminals and the minus signal terminals of the sets are positioned in a row, and the first ground terminals and the second ground terminals are positioned in another row. This allows minimization in size of the connector.

Preferably, the plus and minus signal terminals of one of the terminal sets are positioned in line with the first and second ground terminals of another adjacent one of the terminal sets to be put in a row in the transverse section of the connector. This allows minimization in size of the connector.

Preferably, a distance between the plus signal terminal and the first ground terminal is shorter than a distance between the minus signal terminal and the first ground terminal, while a distance between the minus signal terminal and the second ground terminal is shorter than a distance between the plus signal terminal and the second ground terminal. This surely prevents a noise (current) generated in the plus and minus terminals, limiting a signal transmission loss in the terminals.

Preferably, the plus signal terminal, the minus signal terminal, the first ground terminal, and the second ground terminal are parallel with each other along a longitudinal direction of the terminals and are positioned in a row in a transverse section of the connector. This allows a smaller thickness of the connector.

Preferably, the first ground terminal, the plus signal terminal, the minus signal terminal, and the second ground terminal are arranged sequentially in a lateral direction of the terminals. This surely prevents a noise (current) generated in the plus and minus terminals, limiting a signal transmission loss in the terminals.

Preferably, each of the plus signal terminal, the minus signal terminal, the first ground terminal, and the second ground terminal has a first electrical contact portion positioned at one end for electrical connection to an associated terminal and a second electrical contact portion positioned at the other end for electrical connection to a circuit arranged on a printed circuit board. The connector comprises a retainer body received in the connector housing for retaining the plus signal terminal, the minus signal terminal, the first ground terminal, and the second ground terminal. The four terminals each are embedded in the retainer body at an intermediate portion of the terminal between the first and second electrical contact portions. The retainer body is made of an insulating synthetic resin material.

Thus, the intermediate portion of each terminal is enclosed in the synthetic resin material composing the retainer body. The dielectric degree of the retainer body is adequately determined in consideration of an impedance of the terminals. The impedance of each terminal is stable between the one end and the other end of the terminal. This surely prevents a noise (current) generated in the plus and minus terminals, limiting a signal transmission loss in the terminals.

DETAILED DESCRIPTION OF THE PREFERRED EMBODIMENTS

Figure 1:
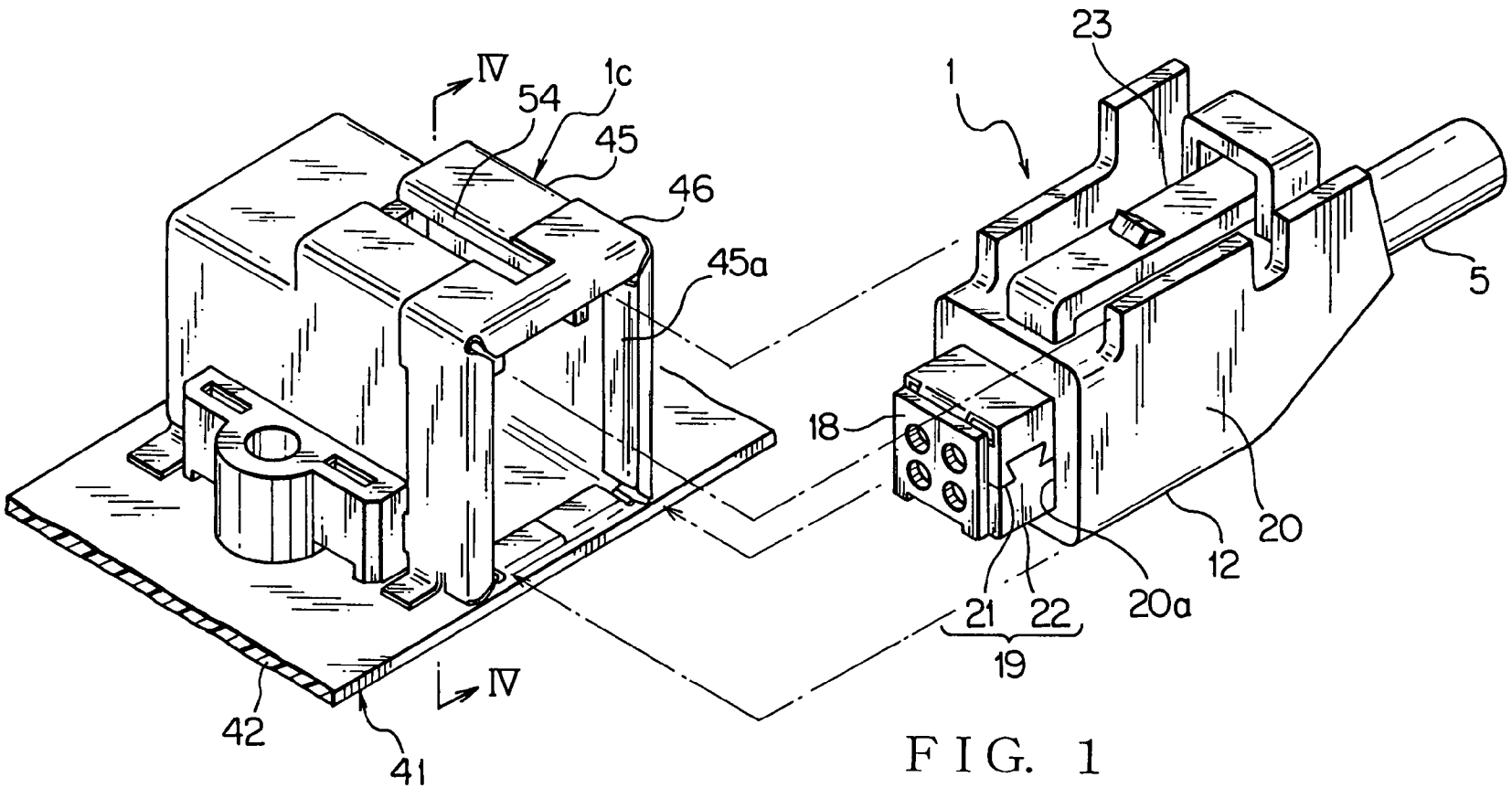
FIG. 1 is a perspective view showing a pair of connectors of a first embodiment according to the present invention for high-speed transmission of differential signals.
Figure 5:
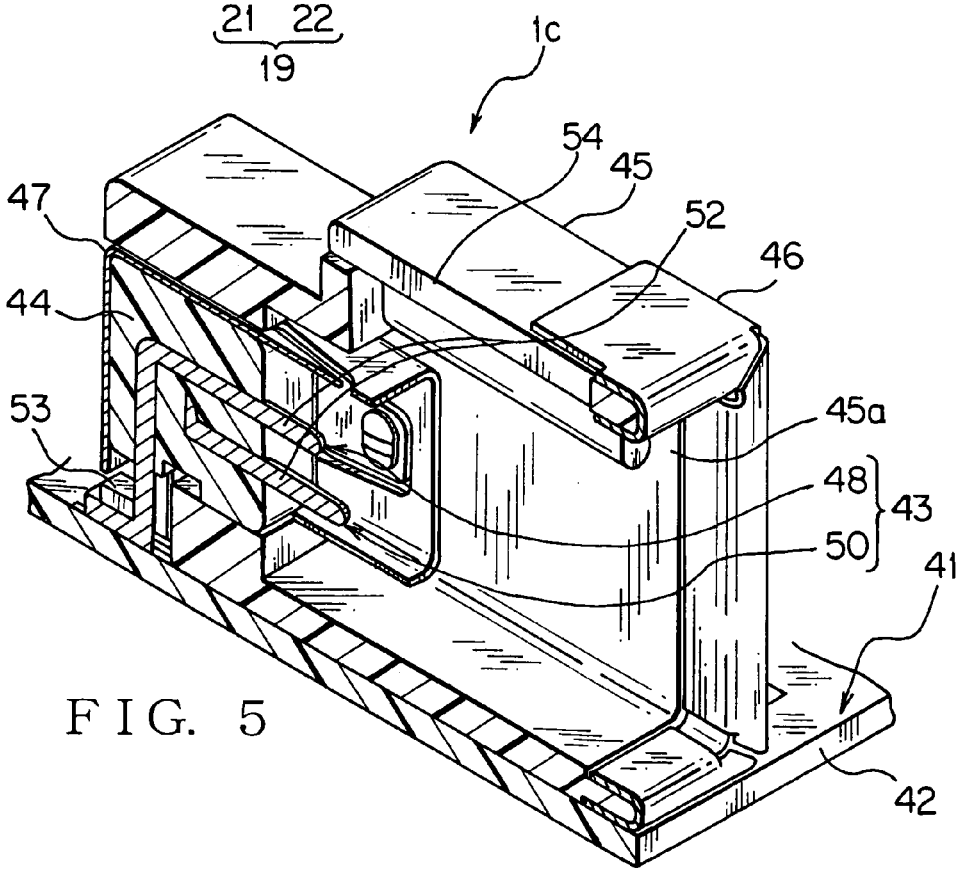
FIG. 5 is a perspective view showing the connector of FIG. 4.
Figure 6:
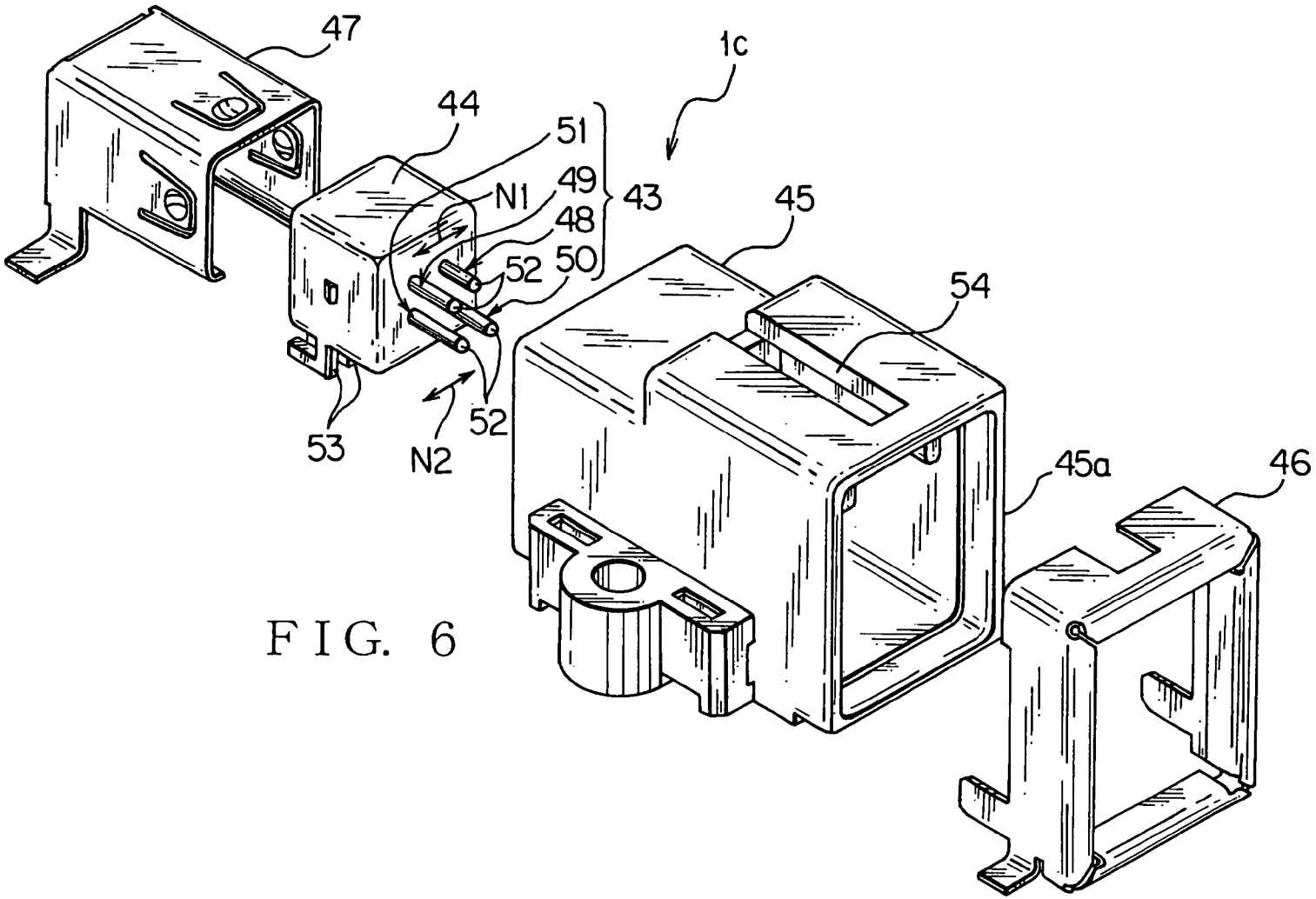
FIG. 6 is an exploded perspective view showing the connector of FIG. 4.
Figure 7:
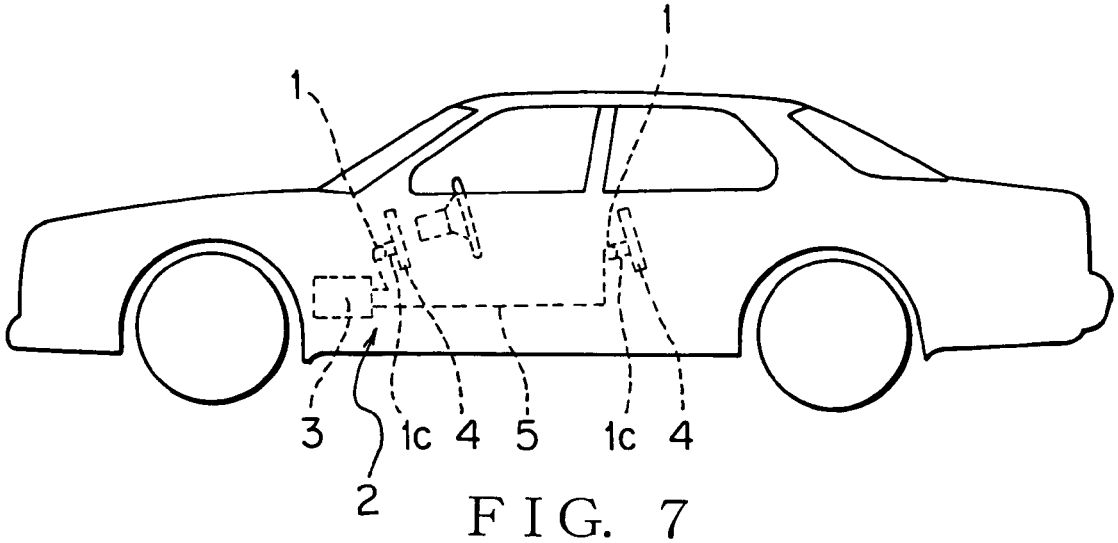
FIG. 7 is an explanatory view showing where the connectors of FIG. 1 are arranged.

Referring to FIGS. 1 to 8, a connector of a first embodiment of the present invention will be discussed. FIG. 1 shows connectors 1, 1*c* engaged with each other, which are used, for example, for connecting a main unit 3 with a display 4 of a navigation system 2 that is an electronic instrument mounted on a car as shown in FIG. 7.

The main unit 3 calculates a present position of the vehicle, and the display 4 indicates a present position and a destination position of the vehicle. The main unit 3 is positioned, for example, in a dashboard. The display 4 is provided at each of a front seat and a rear seat as shown in FIG. 7. This display 4 requires high resolution and needs to indicate the present position in real time. Thus, a high-speed differential signal transmission process is employed for transmitting signals from the main unit 3 to the display 4.

The high-speed differential signal transmission process uses two signal leads (plus and minus) for recognizing "HIGH" and "LOW" of digital signals by a potential difference between the leads. Each signal of the two leads is equal to each other in voltage but offset by 180 degrees in phase from each other. The differential signal transmission can cancel noises generated by the two leads at a receiver side to allow a high speed signal transmission as compared with a single end type. In this specification, a signal in the plus lead is called as a plus signal, while a signal in the minus lead is called as a minus signal. However, the plus signal may have a minus potential and, the minus signal may have a plus potential.

Figure 3:
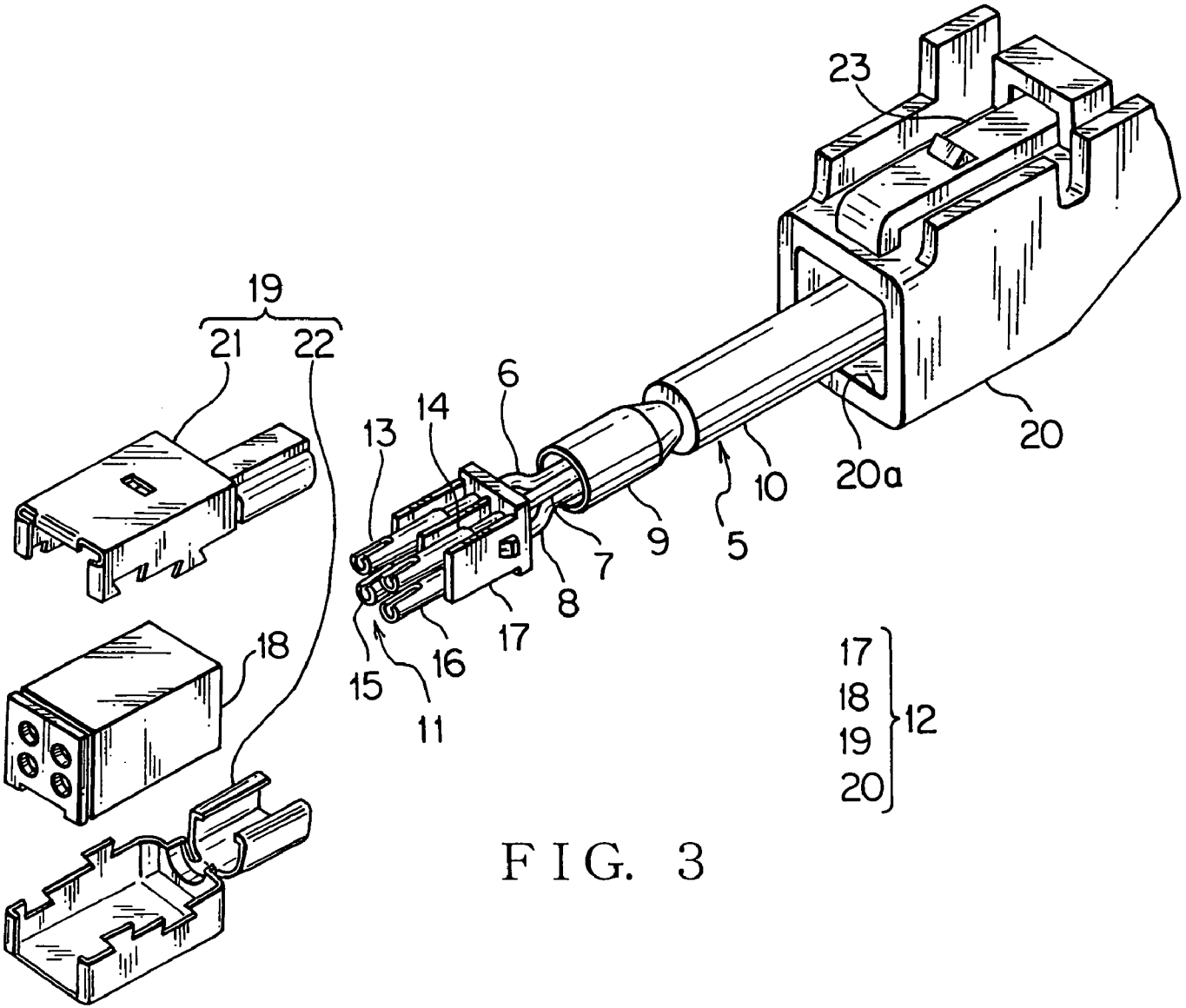
FIG. 3 is an exploded perspective view showing the connector of FIG. 2.

The main unit 3 and the display 4 are electrically connected to each other with a high-speed differential signal transmission type cable 5 via the connectors 1, 1*c* as shown in FIG. 7. The connector 1 is fitted on one end of the cable 5, and the connector 1*c* is fitted on a printed circuit board 41 for engaging with the connector 1. The connectors 1, 1*c* are ones for the high-speed differential signal transmission process. As shown in FIG. 3, the cable 5 includes a plus signal wire 6 for transmitting plus signals, a minus signal wire 7 for transmitting minus signals, a ground wire 8, an aluminum lamination sheet 9, and an insulating tube 10.

Each of the plus signal wire 6, the minus signal wire 7, and the ground wire 8 is a coated one having a conductive core wire and a sheathing layer for covering the core wire. The plus signal wire 6 and the minus signal wire 7 transmit signals (current) from the main unit 3 to the display 4. Each signal of the plus signal wire 6 and the minus signal wire 7 is equal to each other in voltage but offset by 180 degrees in phase from each other.

The ground wire 8 is connected to an earth (not shown) so that an electrical noise generated by a current flow in the plus signal wire 6 or minus signal wire 7 is led to the earth.

The sheet 9 is a thin film made of an aluminum alloy for covering the wire 6, 7, or 8. The sheet 9 is connected to an earth (not shown) to lead an external electrical noise, which would otherwise affects the wires 6, 7, and 8, to the earth. The insulating tube 10, which is made of an electrically insulating synthetic resin, covers the sheet 9.

Figure 2:
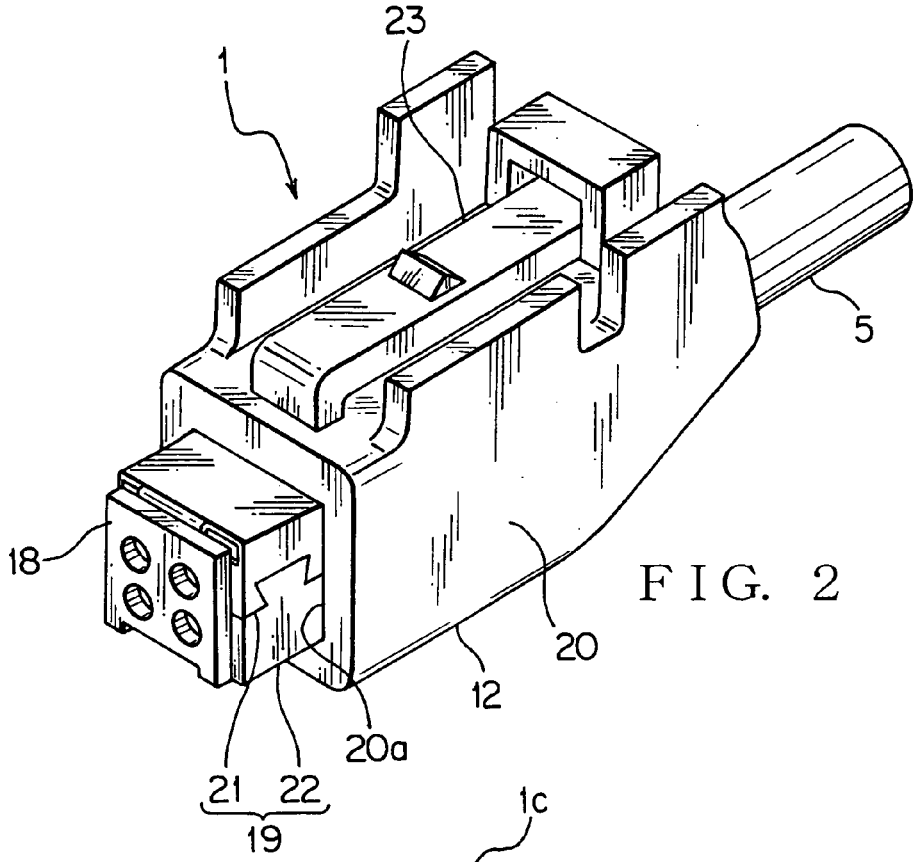
FIG. 2 is a perspective view showing one of the connectors shown in FIG. 1.

As shown in FIG. 2, the connector 1 is fitted to an end of the cable 5. The connector 1 engages with the connector 1*c* fitted on the printed circuit board 41. The connector 1 has a set 11 of terminals and a connector housing 12 as shown in FIG. 3.

The terminal set 11, as illustrated in FIG. 3, includes a plus signal terminal 13, a minus signal terminal 14, a first ground terminal 15, and a second ground terminal 16. The terminals 13 to 16 each are a cylindrical barrel made of an electrically conductive metal. The terminals are arranged in parallel with each other.

The plus signal terminal 13 electrically connects to the plus signal wire 6 of the cable 5, while the minus signal terminal 14 electrically connects to the minus signal wire 7 of the cable 5. The terminal 13, 14 serve to transmit signals (current) from the main unit 3 to the display 4. The signals are equal to each other in voltage but offset by 180 degrees in phase from each other.

The first ground terminal 15 corresponds to the plus signal terminal 13 and connects to the ground wire 8. The first ground terminal 15 leads an electrical noise generated by a signal flow (current) in the plus signal terminal 13 to the earth via the ground wire 8.

The second ground terminal 16 is arranged separately from the first ground terminal 15. The second ground terminal 16 corresponds to the minus signal terminal 14 and connects to the ground wire 8. The second ground terminal 16 leads an electrical noise generated by a signal flow (current) in the minus signal terminal 14 to the earth via the ground wire 8.

Figure 8:
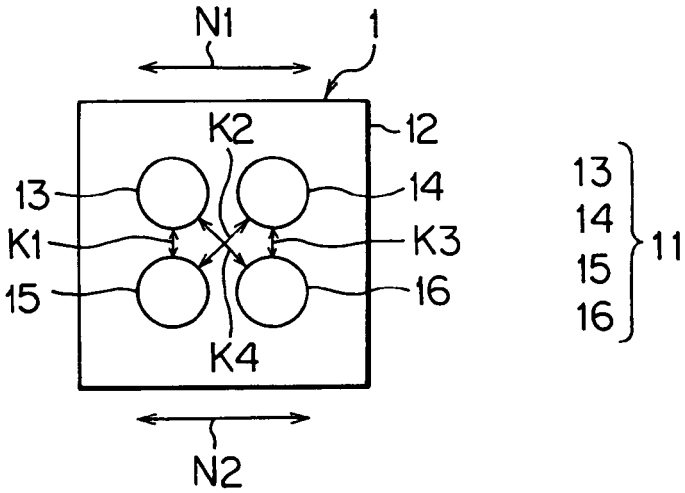
FIG. 8 is a schematic view showing arrangement of terminals of the connector of FIG. 2.

As shown in FIG. 8, the terminals 13 to 16 of the set 11 are positioned respectively at each corner of a quadrangle in a transverse sectional view of the connector housing 12. In the embodiment, the quadrangle is a square.

The plus signal terminal 13 and the minus signal terminal 14 are positioned in a row along a transverse direction (arrow N1) and in parallel with each other along a longitudinal direction of the connector. The first ground terminal 15 and the second ground terminal 16 are positioned in a row along a transverse direction (arrow N2) and in parallel with each other along a longitudinal direction of the connector. The arrows N1, N2 are parallel with each other.

In the terminal set 11, a distance K1 between the first ground terminal 15 and the plus signal terminal 13 is shorter than a distance K2 between the first ground terminal 15 and the minus signal terminal 14. That is, the first ground terminal 15 is positioned nearer to the plus signal terminal 13 than to the minus signal terminal 14.

Furthermore, in the terminal set 11, a distance K3 between the second ground terminal 16 and the minus signal terminal 14 is shorter than a distance K4 between the second ground terminal 16 and the plus signal terminal 13. That is, the second ground terminal 16 is positioned nearer to the minus signal terminal 14 than to the plus signal terminal 13.

The connector housing 12 accommodates the terminals 13 to 16. The connector housing 12, as shown in FIG. 3, has an inner holder 17, an inner casing 18, an electrically conductive case 19, and an outer casing 20. The inner holder 17 is a cubic body made of an electrically insulating synthetic resin. The inner holder 17 retains thus arranged terminals 13 to 16. The inner casing 18 is defined in a box made of an electrically insulating synthetic resin. The inner casing 18 receives the inner holder 17 having the terminals 13 to 16.

The electrically conductive case 19 has an upper half 21 and a lower half 22 which engage with each other. Each half 21 or 22 is made from an electrically conductive plate which is assembled with each other to cover the inner casing 18. The halves 21, 22 electrically connect to the aluminum lamination sheet 9.

The outer casing 20 is defined in a hollow body made of an electrically insulating synthetic resin. The outer casing 20 receives the inner holder 17 retaining the terminals 13 to 16, the inner casing 18 accommodating the inner holder 17, and the electrically conductive case 19 covering the inner casing 18. In FIG. 3, the outer casing 20 has a front opening 20*a* that defines an entrance for the connector housing 12. The outer casing 20 also has a lock arm 23 engaged with the connector 1*c* that is fitted on the printed circuit board 41 of the display 4.

The connector 1 is assembled via the following steps. The terminals 13 to 16 are fitted each to an associated one of the wires 6, 7, and 8 of the cable 5, and then the terminals are retained by the inner holder 17. The inner holder 17 is inserted into the inner casing 18, and then the halves 21, 22 cover the inner holder 17. The electrically conductive case 19 having the inner casing 18 is inserted into the outer casing 20 to complete the connector 1.

Figure 4:
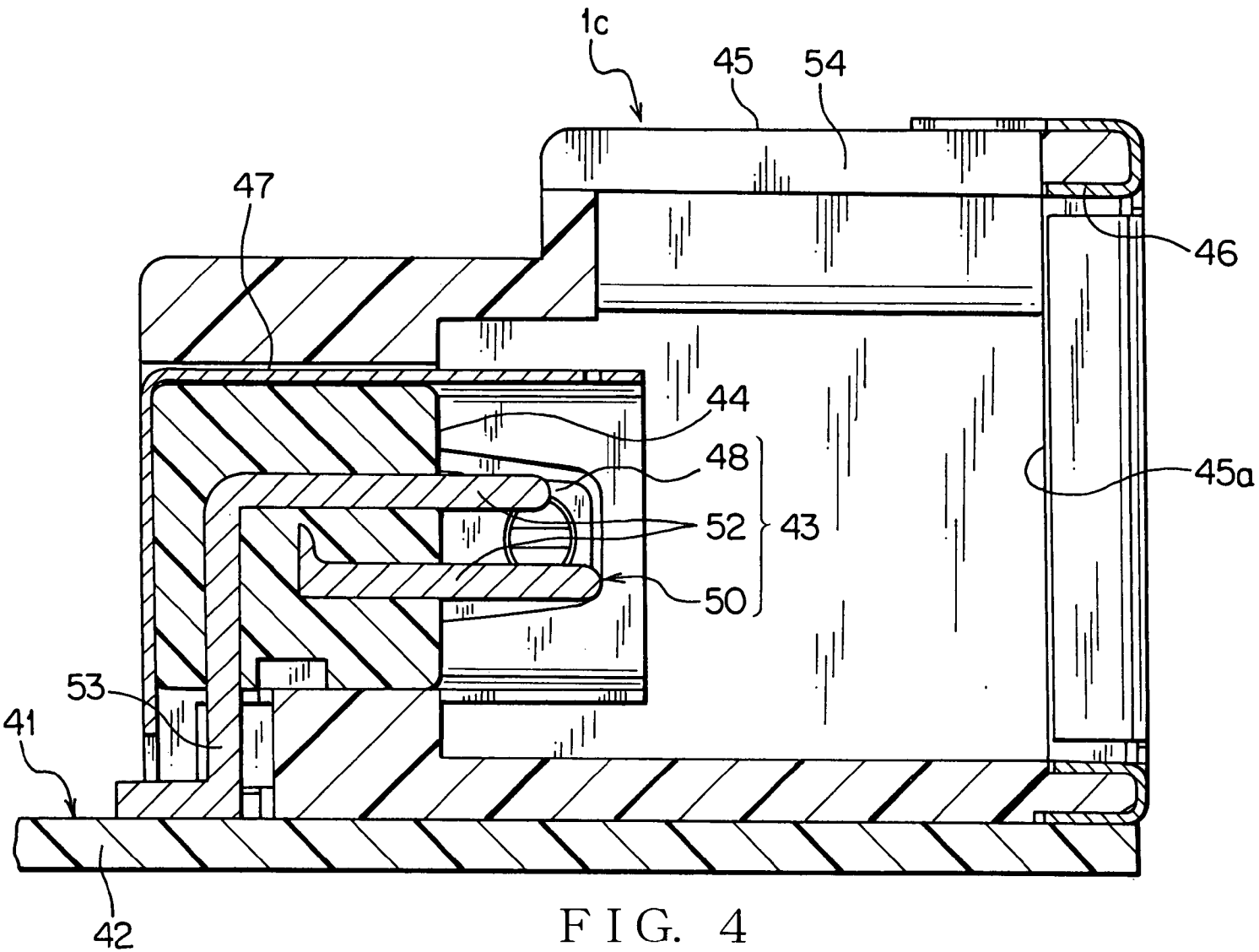
FIG. 4 is a sectional view taken along line IV—IV of FIG. 1 for showing the other of the connectors shown in FIG. 1.

The connector 1*c*, as shown FIG. 1, is fitted on the printed circuit board 41 of the display 4 and engages with the connector 1 connected to the cable 5. As shown in FIGS. 4 and 5, the printed circuit board 41 has a base plate 42 made of an electrically insulating synthetic resin and a circuit (not shown) arranged on the base plate 42. The base plate 42 is a flat plate on which a plurality of electronic components are disposed. The circuit is composed of electrically conductive metal pieces such as copper foils which are stuck on a surface of the base plate 42. The circuit electrically connects the electronic components to the display 4 in a predetermined pattern.

The connector 1*c*, as shown FIG. 6, has a set 43 of terminals, a holder 44, a connector housing 45, a first electrically conductive case 46, and a second electrically conductive case 47.

The terminal set 43, as illustrated in FIG. 6, includes a plus signal terminal 48, a minus signal terminal 49, a first ground terminal 50, and a second ground terminal 51. The terminals 48 to 51 are a cylindrical barrel made of an electrically conductive metal respectively. The terminals are arranged in parallel with each other. Each terminal is defined in a bar of an L-shape in a side view thereof.

The plus signal terminal 48 electrically connects to a circuit of the printed circuit board 41. The plus signal terminal 48 connects to the plus signal terminal 13 of the connector 1 when the connectors 1, 1*c* engage with each other. The minus signal terminal 49 electrically connects to the circuit of the printed circuit board 41. The minus signal terminal 49 connects to the minus signal terminal 14 of the connector 1 when the connectors 1, 1*c* engage with each other. The terminals 13, 14 serve to transmit signals (current) from the main unit 3 to the display 4. The signals are equal to each other in voltage but offset by 180 degrees in phase from each other.

The first ground terminal 50 corresponds to the plus signal terminal 48 and connects to the circuit of the printed circuit board 41. The first ground terminal 50 connects to the first ground terminal 15 when the connectors 1, 1*c* engage with each other. The first ground terminal 50 leads an electrical noise generated by a signal flow (current) in the plus signal terminal 48 to the earth via the ground wire 8.

The second ground terminal 51 is provided separately from the first ground terminal 50. The second ground terminal 51 corresponds to the minus signal terminal 49 and connects to the circuit of the printed circuit board 41. The second ground terminal 51 connects to the second ground terminal 16 of the connector 1 when the connectors 1, 1*c* engage with each other. The second ground terminal 51 leads an electrical noise generated by a signal flow (current) in the minus signal terminal 49 to the earth via the ground wire 8.

Each of the terminals 48 to 51, as shown in FIGS. 4 and 5, has a first contact portion 52 for electrically connecting to the terminal 13, 14, 15, or 16 of the connector 1 and has a second contact portion 53 for electrically connecting to the circuit of the printed circuit board 41. FIGS. 4 and 5 show representatively the plus signal terminal 48 and the first ground terminal 50. The minus signal terminal 49 and the second ground terminal 51 are not discussed in detail because they are the same as the plus signal terminal 48 and the first ground terminal 50 in construction.

The first contact portion 52 is positioned at one end of each of the terminals 48 to 51 while the second contact portion 53 is positioned at the other end of the terminal. The contact portions 52, 53 are disposed in an exposed state, and an intermediate portion between the contact portions 52, 53 is imbedded in the holder 44 made of a synthetic resin.

As shown in FIG. 6, the terminals 48 to 51 of the set 43 are positioned each at each corner of a quadrangle in a transverse sectional view of the connector 1. In the embodiment, the quadrangle is a square.

The plus signal terminal 48 and the minus signal terminal 49 are positioned in a row along a transverse direction (arrow N1) and in parallel with each other along a longitudinal direction of the connector. The first ground terminal 50 and the second ground terminal 51 are positioned in a row along a transverse direction (arrow N2) and in parallel with each other along a longitudinal direction of the connector. The arrows N1, N2 are parallel with each other.

In the terminal set 43, a distance between the first ground terminal 50 and the plus signal terminal 48 is shorter than a distance between the first ground terminal 50 and the minus signal terminal 49. That is, the first ground terminal 50 is positioned nearer to the plus signal terminal 48 than to the minus signal terminal 49.

Furthermore, in the terminal set 43, a distance between the second ground terminal 51 and the minus signal terminal 49 is shorter than a distance between the second ground terminal 51 and the plus signal terminal 48. That is, the second ground terminal 51 is positioned nearer to the minus signal terminal 49 than to the plus signal terminal 48.

The holder 44 is a cubic body made of an electrically insulating synthetic resin. The holder 44 is received in the connector housing 45. The holder 44 retains thus arranged terminals 48 to 51, since the intermediate portions of the terminals 48 to 51 are imbedded in the holder 44 by an inert molding process.

The synthetic resin of the holder 44 is selected in consideration of an impedance between the ends of the terminal. The impedance and an induction rate of the holder 44 vary with materials composing the holder 44.

The connector housing 45, as shown in FIGS. 4 and 5, receives the holder 44 having the terminals 48 to 51. The connector housing 45 is a hollow body made of an electrically insulating synthetic resin. The connector housing 45 is formed with a locking hole 54 near its front opening 45*a* (FIG. 1) for engaging with the lock arm 23 of the connector 1. The connector housing 45 is secured on the base plate 42 of the printed circuit board 41.

The first electrically conductive case 46 is made from an electrically conductive plate and formed in a frame. The first electrically conductive case 46 covers partially the connector housing 45 around the opening 45*a*. The second electrically conductive case 47 is made form an electrically conductive plate and formed in a shell. The second electrically conductive case 47 covers the holder 44 and is received in the connector housing 45. The cases 46, 47 are electrically connected to the circuit of the printed circuit board 41 to lead to an earth via the circuit.

The connector 1*c* is assembled via the following steps. An insert molding process forms the holder 44 having the terminals 48 to 51. The second electrically conductive case 47 covers the holder 44, and the holder 44 is inserted into the connector housing 45. The first electrically conductive case 46 covers partially the connector housing 45 near the opening 45*a* to complete the connector 1*c*. The connector 1*c* is secured on the printed circuit board 41 of the display 4. Thereby, the second contact portions 53 of the terminals 48 to 51 and the conductive cases 46, 47 electrically connect to the circuit of the printed circuit board 41. The engagement of the lock arm 23 with the locking hole 54 ensures the mating of the connectors 1, 1*c*.

In the embodiment, the first ground terminal 15 or 50 corresponds to the plus signal terminal 13 or 48, and the second ground terminal 16 or 51 corresponds to the minus signal terminal 14 or 49. Thereby, a current flow in the terminals 13 and 48 generates an induction current in the first ground terminals 15 and 50, and a current flow in the minus signal terminals 14 and 49 generates an induction current in the second ground terminals 16 and 51. The first ground terminals 15 and 50 are provided separately from the second ground terminals 16 and 51.

Thus, a current flow in the plus signal terminals 13 and 48 generates an induction current neither in the minus signal terminals 14 and 49 nor in the second ground terminals 16 and 51, while a current flow in the second ground terminals 16 and 51 generates an induction current neither in the plus signal terminals 13 and 48 nor in the first ground terminals 15 and 50. This prevents a noise (current) generated in the plus and minus terminals, limiting a signal transmission loss in the terminals 13, 48, 14, and 49.

Each of the plus signal terminal 13 or 48, the minus signal terminal 14 or 49, the first ground terminal 15 or 50, and the second ground terminal 16 or 51 is positioned in parallel with each other at each corner of a square. This allows minimization in size of the connectors.

The first ground terminal 15 or 50 is positioned nearer to the plus signal terminal 13 or 48 than to the minus signal terminal 14 or 49, while the second ground terminal 16 or 51 is positioned nearer to the minus signal terminal 14 or 49 than to the plus signal terminal 13 or 48.

This surely prevents a noise (current) generated in the plus and minus terminals 13, 48, 14, and 49, limiting a signal transmission loss in the terminals 13, 48, 14, and 49.

The terminals 48 to 51 of the connector 1*c* are embedded in the holder 44 at intermediate portions of the terminals. Thus, the intermediate portion of each terminal is enclosed in the synthetic resin material composing the holder 44 not to be exposed outward. Thus, the impedance of each terminal is stable between the one end 52 and the other end 53 of the terminal. This surely prevents a noise (current) generated in the terminals 48 to 51, limiting a signal transmission loss in the terminals.

In the first embodiment, the terminals 13 to 16 each have a circular barrel body. However, the terminals 13 to 16, as shown in the connector 1*a* of FIG. 9, each may be a plate having a rectangular section with a comparatively larger depth. Each of the terminals 13 to 16 is positioned at each corner of a quadrangle (a square). In the connector 1*a* of FIG. 6, a component having the same numeral of the connector 1 is the same as that of connector 1 and will not be discussed again.

Figure 9:
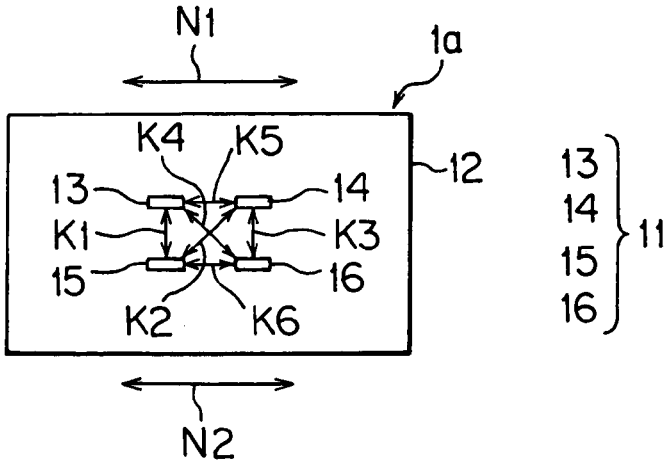
FIG. 9 is a schematic view showing arrangement of terminals different from those of FIG. 8.
Figure 10:
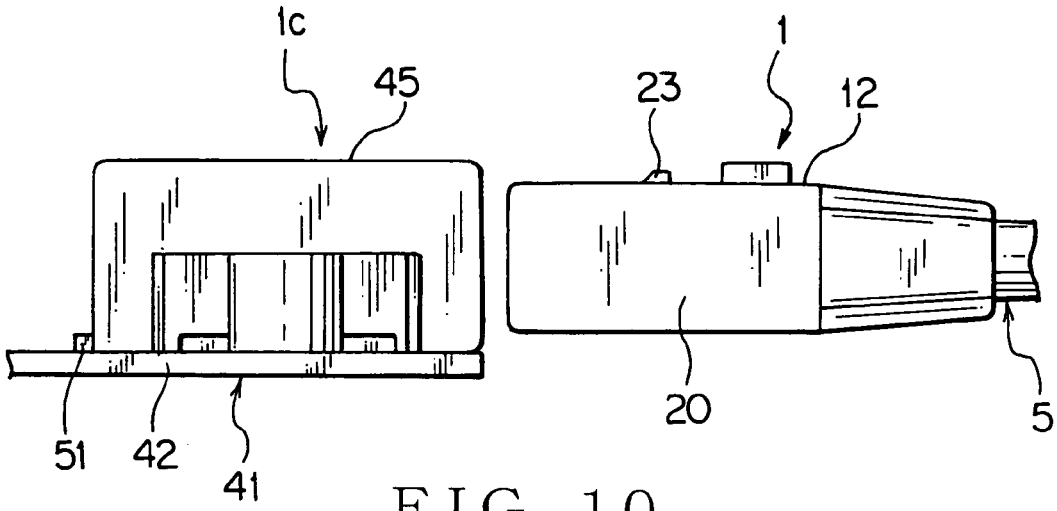
FIG. 10 is a side view showing a pair of connectors of a second embodiment according to the present invention for high-speed transmission of differential signals.
Figure 11:
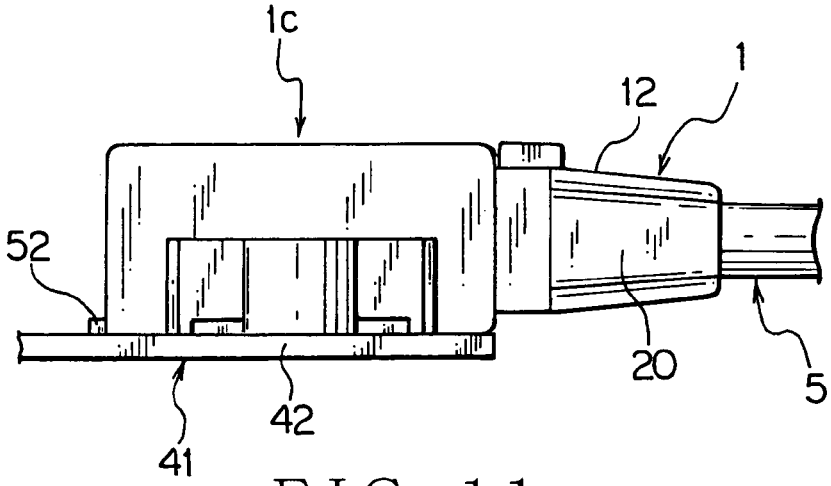
FIG. 11 is a side view showing the pair of connectors of FIG. 10, the connectors having been engaged with each other.

In FIG. 9, a distance K5 between the plus signal terminal 13 and the minus signal terminal 14 is equal to a distance K6 between the first ground terminal 15 and the second ground terminal 16. Furthermore, a distance K1 between the plus signal terminal 13 and the first ground terminal 15 is equal to a distance K3 between the minus signal terminal 14 and the second ground terminal 16. The distance K5 or K6 is longer than the distance K1 or K3.

In the example of FIG. 9, as well as the aforementioned embodiment, a current flow in the plus signal terminal 13 generates an induction current in the first ground terminal 15, and a current flow in the minus signal terminal 14 generates an induction current in the second ground terminal 16.

Thus, a current flow in the plus signal terminal 13 generates an induction current neither in the minus signal terminal 14 nor in the second ground terminal 16, while a current flow in the minus signal terminal 14 generates an induction current neither in the plus signal terminal 13 nor in the first ground terminal 15. This prevents a noise (current) generated in the plus and minus signal terminals 13, 14, limiting a signal transmission loss in the terminals 13, 14.

Referring to FIGS. 10 to 16, a second embodiment of the present invention will be discussed. The same reference numeral as the first embodiment is applied to a component the same as that of the first embodiment and will not be discussed again.

The connectors 1, 1*c* shown in FIGS. 10, 11, 14, and 15 mate with each other as well as the first embodiment. The connector 1 is fitted to the cable 5 while the connector 1*c* is fitted on the printed circuit board 41. The connectors 1, 1*c* of the second embodiment are also used for high-speed transmission of differential signals.

Figure 12:
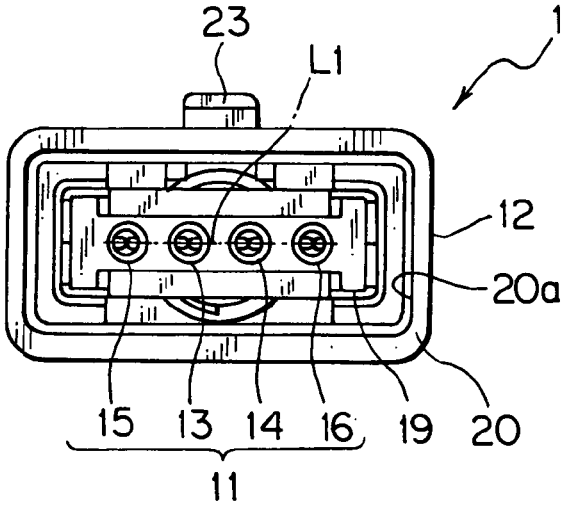
FIG. 12 is a front view showing one of the connectors of FIG. 10.

In the second embodiment, the connector 1 has terminals 13 to 16 disposed in parallel along a longitudinal direction of the connector as shown in FIG. 12. The terminals 13 to 16 are positioned in a row along a transverse direction of the connector as shown FIGS. 12 and 16

The terminals 13 to 16 are positioned with regular intervals L1. In FIG. 12, from the left, there are sequentially disposed the first ground terminal 15, the plus signal terminal 13, the minus signal terminal 14, and the second ground terminal 16. The first ground terminal 15 is positioned nearer to the plus signal terminal 13 than to the minus signal terminal 14, while the second ground terminal 16 is positioned nearer to the minus signal terminal 14 than to the plus signal terminal 13.

Figure 13:
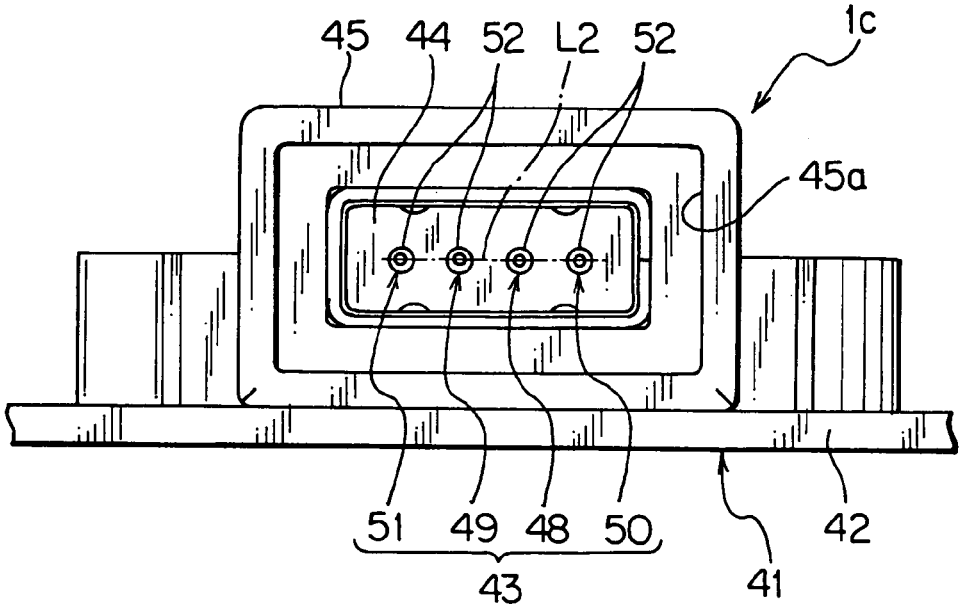
FIG. 13 is a front view showing the other of the connectors of FIG. 10.
Figure 14:
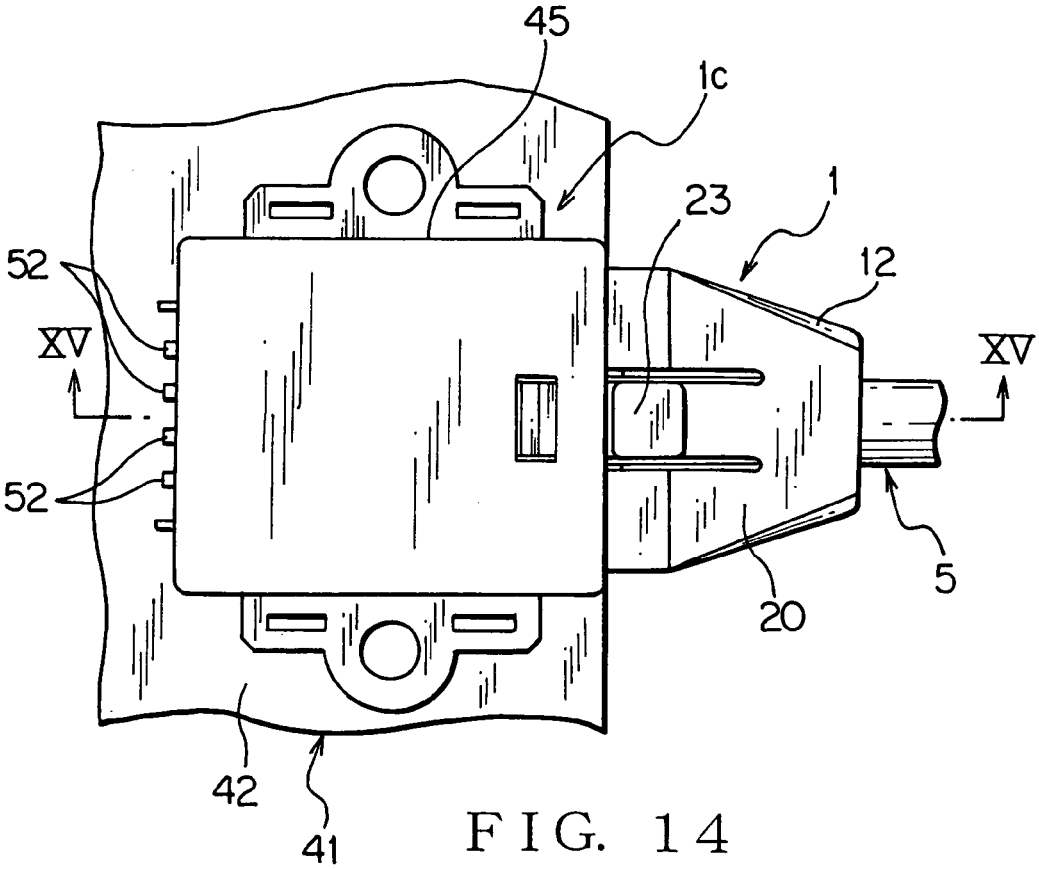
FIG. 14 is a plan view showing the pair of connectors of FIG. 11, the connectors having been engaged with each other.
Figure 15:
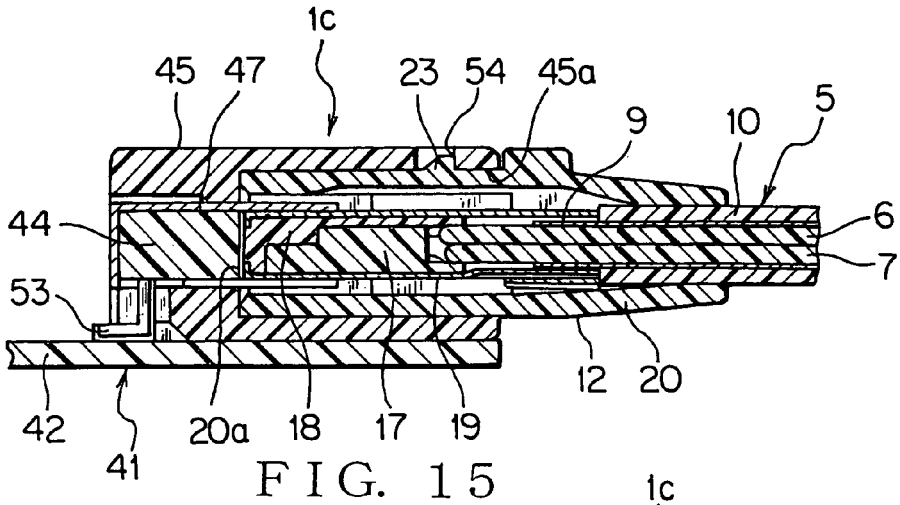
FIG. 15 is a sectional view taken along line XV—XV of FIG. 14.

In the second embodiment, the connector 1*c* has terminals 48 to 51 disposed in parallel along a longitudinal direction of the connector as shown in FIG. 13. The terminals 48 to 51 are positioned in a row along a transverse direction of the connector as shown FIG. 13.

The terminals 48 to 51 are positioned with regular intervals L2 (chain line in FIG. 13). In FIG. 13, from the right, there are sequentially disposed the first ground terminal 50, the plus signal terminal 48, the minus signal terminal 49, and the second ground terminal 51. The first ground terminal 50 is positioned nearer to the plus signal terminal 48 than to the minus signal terminal 49, while the second ground terminal 51 is positioned nearer to the minus signal terminal 49 than to the plus signal terminal 48.

As well as the first embodiment, a current flow in the plus signal terminals 13 and 48 generates an induction current in the first ground terminals 15 and 50, and a current flow in the minus signal terminals 14 and 49 generates an induction current in the second ground terminals 16 and 51.

Thus, a current flow in the plus signal terminals 13 and 48 generates an induction current neither in the minus signal terminals 14 and 49 nor in the second ground terminals 16 and 51, while a current flow in the second ground terminals 16 and 51 generates an induction current neither in the plus signal terminals 13 and 48 nor in the first ground terminals 15 and 50. This prevents a noise (current) generated in the plus and minus terminals, limiting a signal transmission loss in the terminals 13, 48, 14, and 49.

In the connectors 1, 1*c* of the second embodiment, the terminals 13 to 16 and 48 to 51 are parallel with each other along the longitudinal direction and in line with each other along the transverse direction. This allows minimization in depth of the connectors.

The inventors of the present invention carried out a simulation to know operational effects of the connectors 1, 1*c* of the first and second embodiments by a finite element solution (including frequency factor) and a finite integration algorism (including time factor). The simulation was made only to the connector 1, because the terminals 48 to 51 of the connector 1*c* are arranged in the same way as the terminals 13 to 16 of the connector 1. An alternating current is supplied from one end to the other end of each of the terminals 13, 14, 103, and 104 to calculate an output current intensity to obtain a loss degree of the input current.

Figure 17:
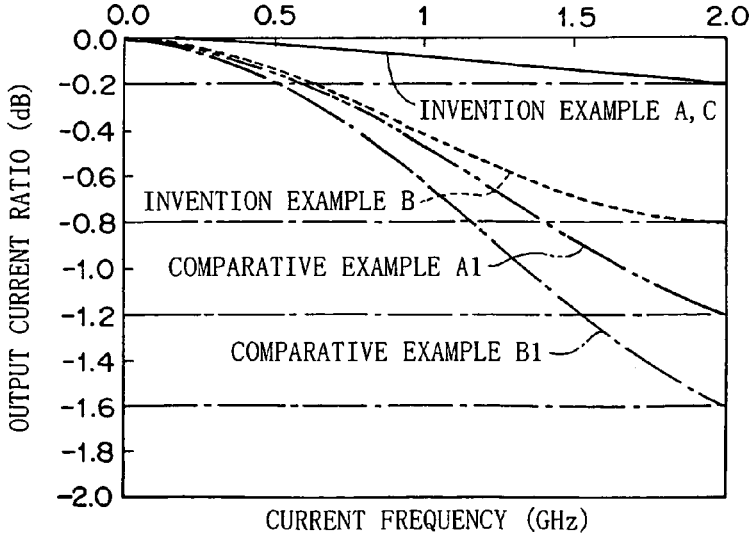
FIG. 17 is a graph of a simulation result to show operational effects of the connectors of the first and second embodiments according to the present invention.

FIG. 17 shows a result of the simulation. Graphs of FIG. 17 show relationships between frequencies of input currents and intensities of output currents regarding the embodiments and comparative examples.

In FIG. 17, a transverse axis shows frequencies of input alternating currents, the frequencies increasing along a rightward direction, and a vertical axis shows ratios (indicated by dB) of output current intensity. A lower ratio of the output current shows a larger loss of the input current.

Figure 16:
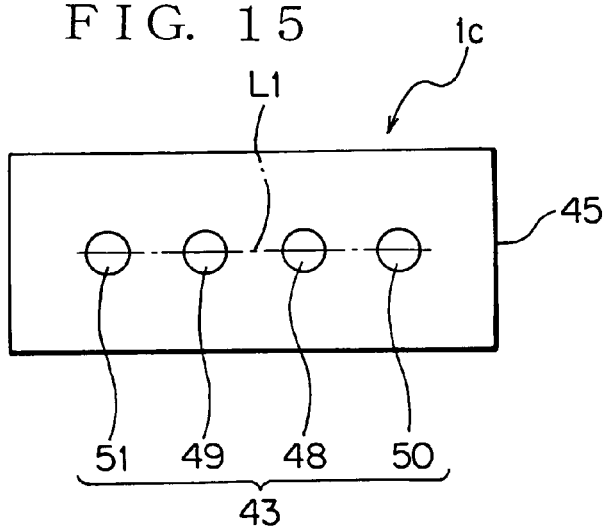
FIG. 16 is a schematic view showing arrangement of terminals of the connector of FIG. 12.
Figure 20:
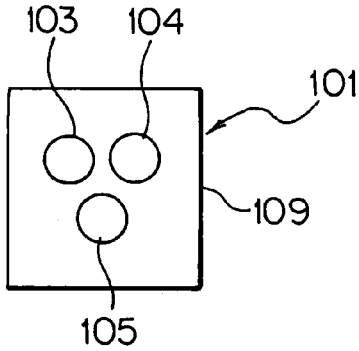
FIG. 20 is a schematic view showing arrangement of terminals of a connector of a comparative example A1 that was employed for the simulations of FIGS. 17 to 19.
Figure 21:
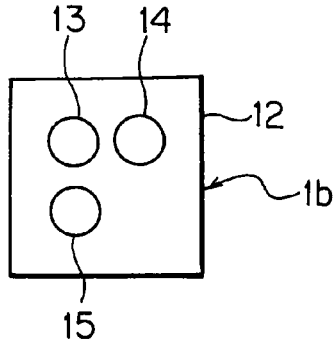
FIG. 21 is a schematic view showing arrangement of terminals of a connector of a comparative example B1 that was employed for the simulation of FIG. 17.

In FIG. 17, a solid line corresponds to an invention example A that is the connector 1 of the first embodiment of FIG. 8; a dotted line corresponds to an invention example B that is the connector 1*a* of first the embodiment of FIG. 9; a solid line corresponds to an invention example C that is the connector 1 of the second embodiment of FIG. 16; a two-dot chain line corresponds to a comparative example A1 that is a connector 101 of FIG. 20; and a one-dot chain line corresponds to a comparative example B1 that is a connector 1*b* of FIG. 21.

Figure 38:
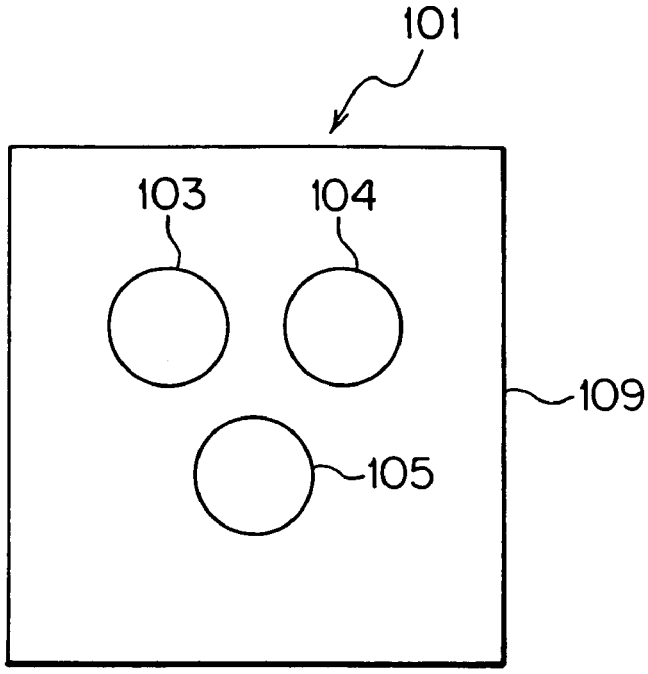
PRIOR ART FIG. 38
FIG. 38 is a schematic view showing arrangement of terminals of a conventional connector.

The connector 101 of FIG. 20 has a configuration generally the same as that of the conventional one of FIG. 38. Thus, a component having the same reference numeral as that of the conventional connector and will not be discussed again.

The connector 1*b* of FIG. 21 has a configuration similar to the connector 1 of the first embodiment except that one of the grand terminals 15, 16 is deleted. Thus, a component having the same reference numeral as the first embodiment is the same as that of the connector 1 and will not be discussed again. In the connector 1*b* of FIG. 21, the second ground terminal 16 is deleted, and the terminals 13, 14, and 15 are each arranged at each corner of a triangle in a transverse section of the connector 1*b*.

In the simulation result of FIG. 17, the invention example A and the invention example C are equal to each other. Thus, in FIG. 17, the invention example A and the invention example C are shown by the same solid line.

Referring to the simulation of FIG. 17, each of the invention examples A, B, and C decreases in intensity of the output current to increase in loss of the output current with increase of a frequency of an input alternating current as well as the comparative examples A1 and B1. When the current frequency is 2.0 GHz, the current intensity ratio is −1.2 dB in the comparative example A1 and −1.6 dB in the comparative example B1. At the same current frequency, the current intensity ratio is −0.2 dB in the invention examples A, C and −0.8 dB in the invention example B. Thus, it was found that the invention examples A, B, and C each achieve a current loss considerably smaller than those of the comparative examples A1 and B1. The provision of the first and second ground terminals 15, 16 decreases a signal transmission loss of each of the terminals 13 and 14.

Figure 18:
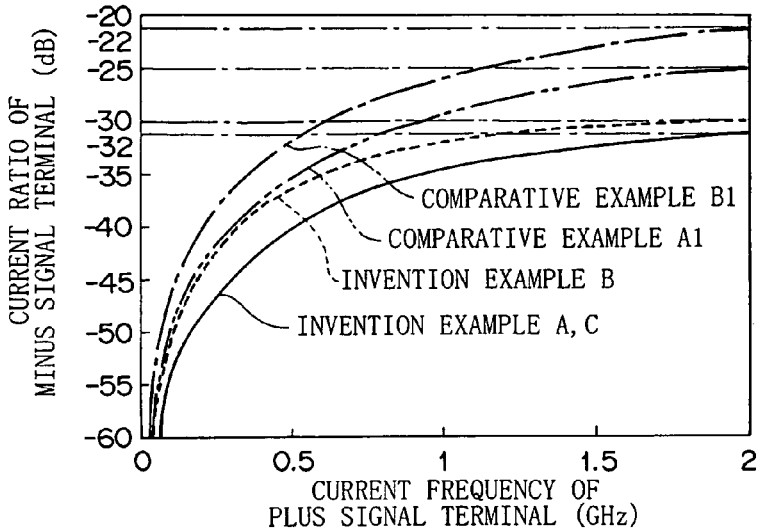
FIG. 18 is a graph of a simulation result to show other operational effects of the connectors of the first and second embodiments according to the present invention.
Figure 19:
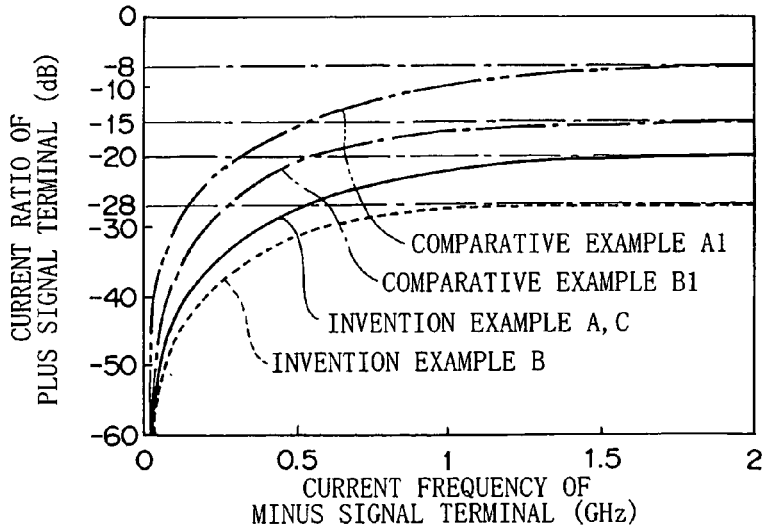
FIG. 19 is a graph of a simulation result to show other operational effects of the connectors of the first and second embodiments according to the present invention.

This was also proved by the following another simulation result of a crosstalk characteristic of the connectors. The simulation result is shown in FIGS. 18 and 19. In the simulation associated with FIG. 18, an output current at a minus signal terminal 14, 104, or 107 due to an alternating current flowing from one end to the other end of a plus signal terminal 13, 103, or 106 was calculated to know a crosstalk degree of the currents. The relationships between the intensity of the output currents and the current frequencies were obtained.

In FIG. 18, a lateral axis shows frequencies of alternating currents. The frequencies increase along a rightward direction in FIG. 18. A vertical axis shows a ratio of an output current to a corresponding input alternating current, which is scaled by dB. In FIG. 18, a lower output ratio shows a smaller output current in the minus signal terminal 14, 104, or 107 to an input current of the plus signal terminal 13, 103, or 106. That is, a lower current ratio shows a better crosstalk characteristic of the connector 1, 1*a*, 101, or 102.

In the simulation associated with FIG. 19, an output current at a plus signal terminal 13, 103, or 106 due to an alternating current flowing from one end to the other end of a minus signal terminal 14, 104, or 107 was calculated to know a crosstalk degree of the currents. The relationships between the intensities of the output currents and the current frequencies were obtained.

In FIG. 19, a lateral axis shows frequencies of alternating currents. The frequencies increase along a rightward direction in FIG. 19. A vertical axis shows a ratio of an output current to a corresponding input alternating current, which is scaled by dB (decibel). In FIG. 19, a lower output ratio shows a smaller output current in the plus signal terminal 13, 103, or 106 to an input current of the minus signal terminal 14, 104, or 107. That is, the lower current ratio shows a better crosstalk characteristic of the connector 1, 1*a*, 101, or 102.

Figure 22:
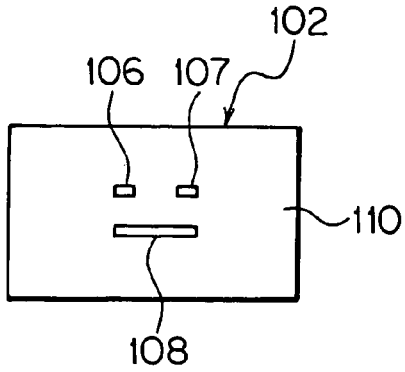
FIG. 22 is a schematic view showing arrangement of terminals of a connector of a comparative example B1 that was employed for the simulations of FIGS. 18 and 19.

In the simulation of FIGS. 18 and 19, a solid line corresponds to an invention example A associated with the connector 1 of the first embodiment shown in FIG. 8; a dotted line corresponds to an invention example B associated with the connector 1*a* of the first embodiment shown in FIG. 9; a solid line corresponds to an invention example C associated with the connector 1*c* of the second embodiment shown in FIG. 16; a two-dot chain line corresponds to a comparative example A1 associated with the connector 101 shown in FIG. 20; and a one-dot chain line corresponds to a comparative example B1 associated with the connector 102 shown in FIG. 22.

Figure 39:
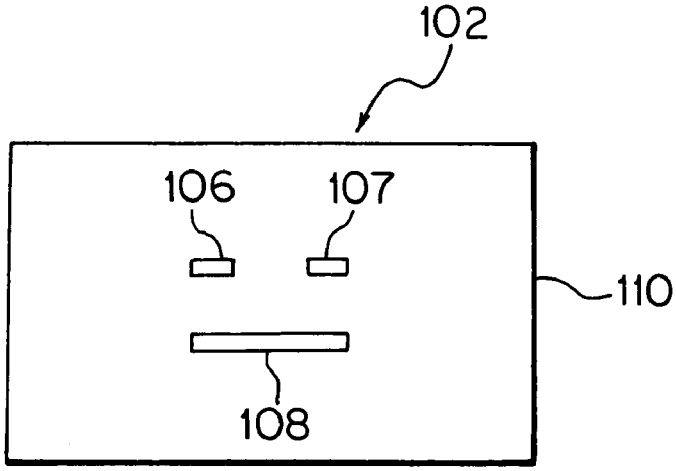
PRIOR ART FIG. 39
FIG. 39 is a schematic view showing arrangement of terminals of another conventional connector.

The connector 102 shown in FIG. 22 has a configuration substantially the same as that of the conventional art shown in FIG. 39. Thus, the same reference numeral is applied to the same component, which will not be discussed again.

In the simulation result of FIG. 18, the invention example A and the invention example C are equal to each other. Thus, in FIG. 17, the invention example A and the invention example B are shown by the same solid line.

Referring to the simulation result of FIG. 18, each of the invention examples A, B, and C increases in intensity of the output current to increase the current generated in the minus signal terminal 14, 104, or 107 with increase of the frequency of the alternating input current as well as the comparative examples A1 and B1. When the current frequency is 2.0 GHz, the current intensity ratio is −25 dB in the comparative example A1 and −22 dB in the comparative example B1. At the same current frequency, the current intensity ratio is −32 dB in the invention examples A, C and −30 dB in the invention B. Thus, it was found that the invention examples A, B, and C each provide a current considerably smaller than those of the comparative examples A1 and B1 in the minus signal terminal 14, 104, or 107.

Figure 23:
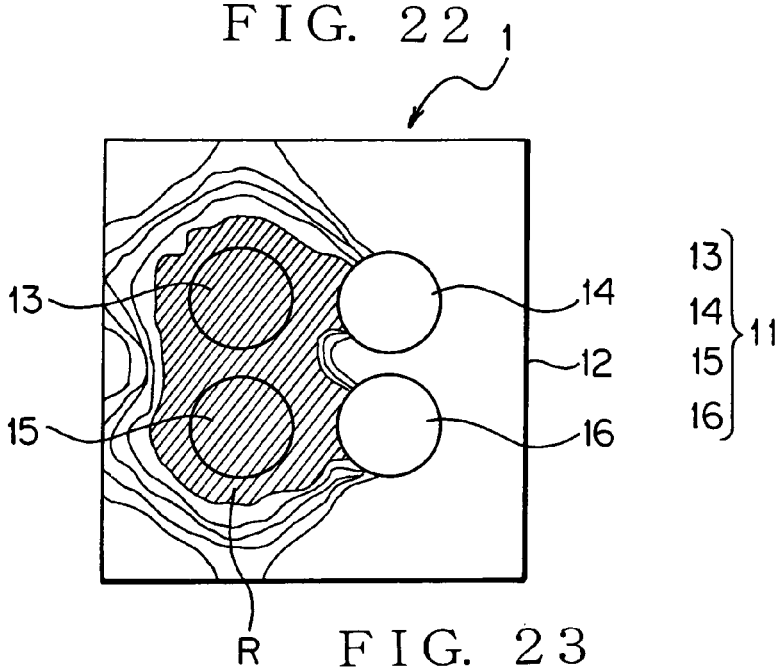
FIG. 23 is a schematic view showing an electric field obtained by the simulation of FIG. 18 due to a current flow in a plus signal terminal of an invention example A.
Figure 25:
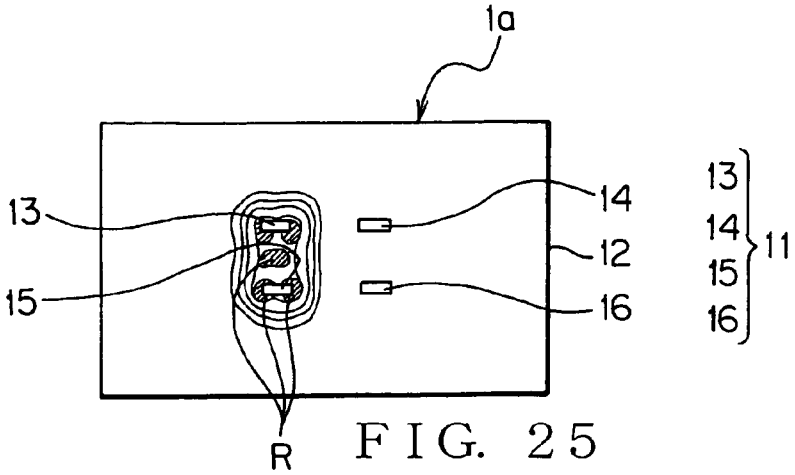
FIG. 25 is a schematic view showing an electric field obtained by the simulation of FIG. 18 due to a current flow in a minus signal terminal of an invention example B.
Figure 27:
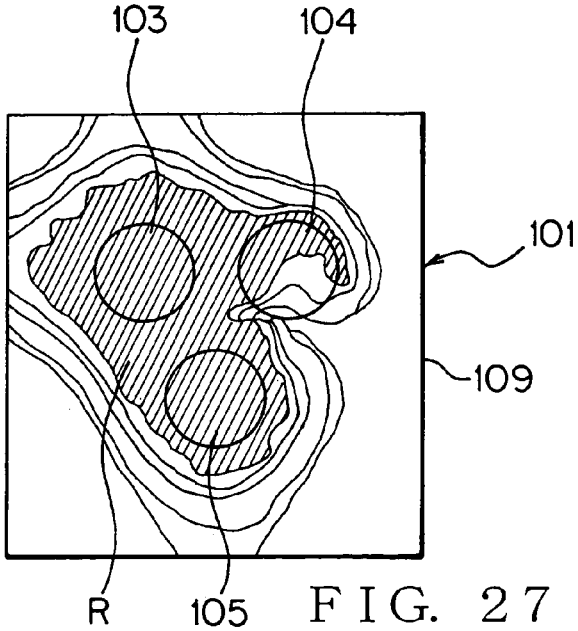
FIG. 27 is a schematic view showing an electric field obtained by the simulation of FIG. 18 due to a current flow in a minus signal terminal of the comparative example A1.

This result was also proved by electric fields shown in FIGS. 23, 25, 27, and 29. The electric fields were obtained by a finite integration algorism. FIG. 23 corresponds to an electric field of the invention example A; FIG. 25 corresponds to the invention example B; FIG. 27 corresponds to the comparative example A1; and FIG. 29 corresponds to the comparative example B1. FIGS. 23, 25, 27, and 29 show contour lines of electric fields, and a highest-density electric field zone R is shown by parallel diagonal lines. Outward from the zone R, the electric field becomes lower gradually in density.

FIGS. 23, 25 of the invention examples A, B show that almost no electric field is generated around the minus signal terminal 14 by a flowing current in the plus signal terminal 13. On the contrary, FIGS. 27, 29 of the comparative examples A1, B1 show that a considerable electric field is generated around the minus signal terminal 104 or 107 by a flowing current in the plus signal terminal 103 or 106.

Thus, it was found that the invention examples A, B can limit generation of an induction current in the minus signal terminal 14 and the second ground terminal 16 when a flowing current in the plus signal terminal 13 generates an induction current in the first ground terminal 15.

In the simulation result of FIG. 19, the invention examples A and C are equal to each other. Thus, in FIG. 19, the invention examples A and C are shown by the same solid line.

Referring to the simulation result of FIG. 19, each of the invention examples A, B, and C increases in intensity of the output current to increase current generated in the plus signal terminal 13, 103, or 106 with increase of frequency of the alternating input current as well as the comparative examples A1 and B1. When the current frequency is 2.0 GHz, the current intensity ratio is −8 dB in the comparative example A1 and −15 dB in the comparative example B1. At the same current frequency, the current intensity ratio is −20 dB in the invention examples A, C and −28 dB in the invention B. Thus, it was found that the inventions A, B, and C each provide a current considerably smaller than those of the comparative examples A1 and B1 in the plus signal terminal 13, 103, or 106.

Figure 24:
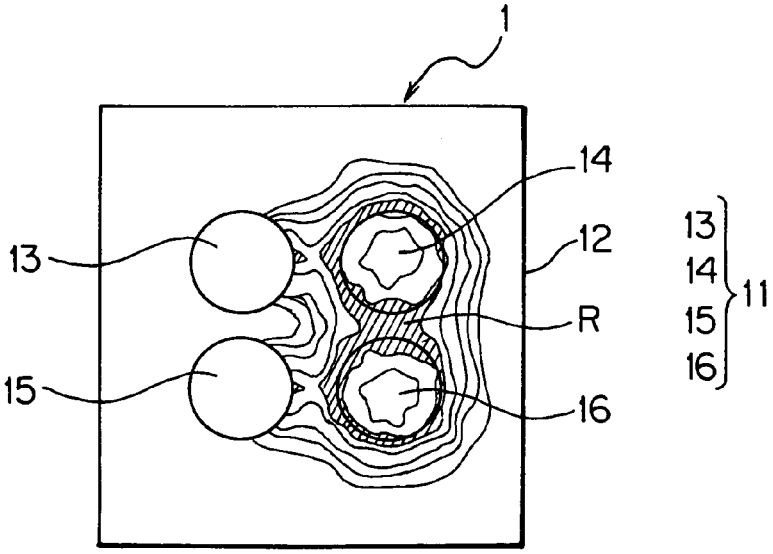
FIG. 24 is a schematic view showing an electric field obtained by the simulation of FIG. 19 due to a current flow in a minus signal terminal of the invention example A.
Figure 26:
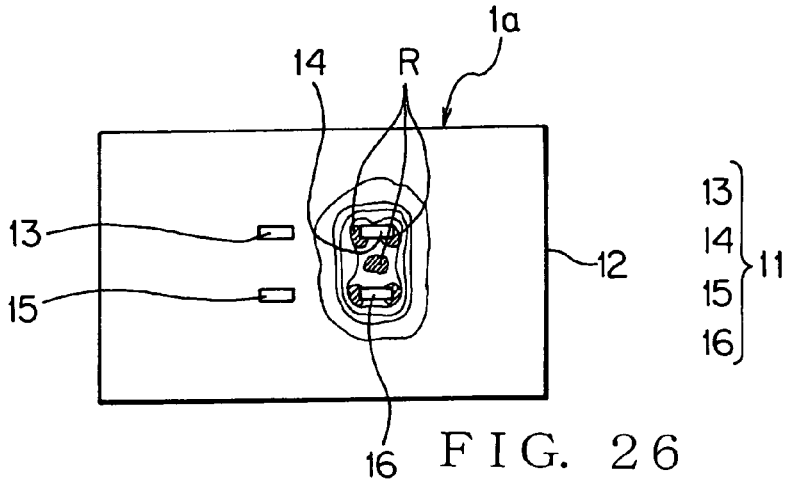
FIG. 26 is a schematic view showing an electric field obtained by the simulation of FIG. 19 due to a current flow in a minus signal terminal of the invention example B.
Figure 28:
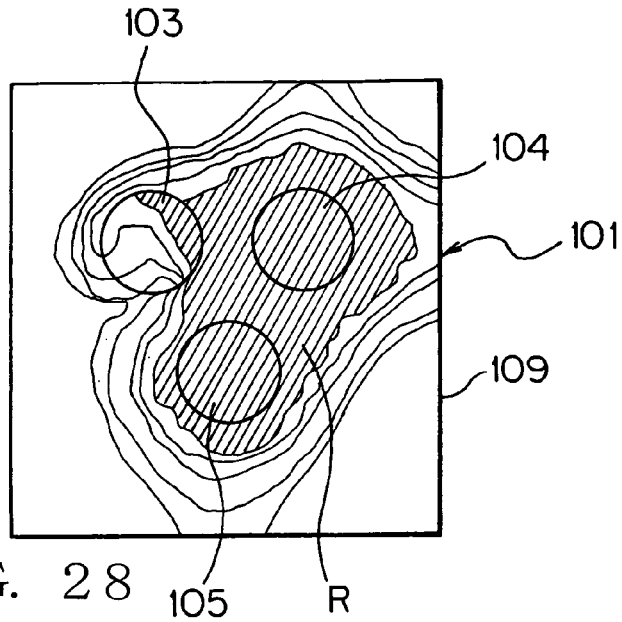
FIG. 28 is a schematic view showing an electric field obtained by the simulation of FIG. 19 due to a current flow in a minus signal terminal of the comparative example A1.
Figure 29:
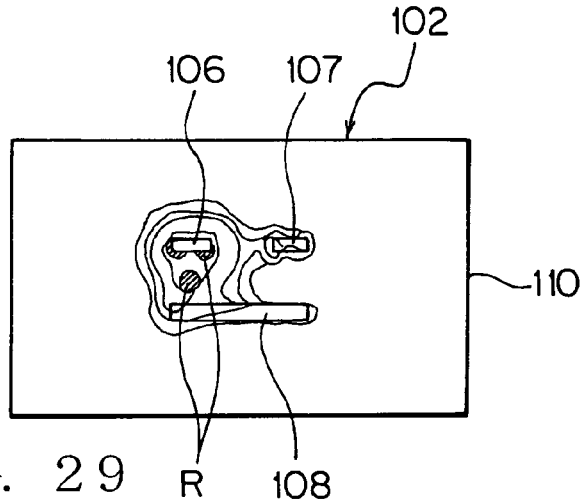
FIG. 29 is a schematic view showing an electric field obtained by the simulation of FIG. 18 due to a current flow in a minus signal terminal of the comparative example B1.
Figure 30:
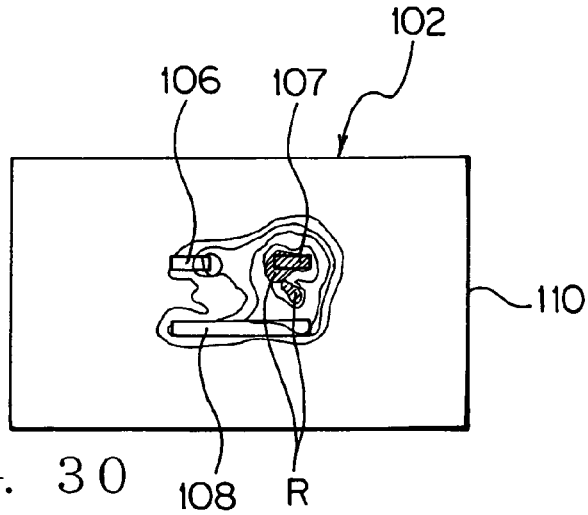
FIG. 30 is a schematic view showing an electric field obtained by the simulation of FIG. 19 due to a current flow in a minus signal terminal of the comparative example B1.

This result was also proved by electric fields shown in FIGS. 24, 26, 28, and 30. The electric fields were obtained by a finite integration algorism. FIG. 24 corresponds to an electric field of the invention example A; FIG. 26 corresponds to the invention example B; FIG. 28 corresponds to the comparative example A1; and FIG. 30 corresponds to the comparative example B1. FIGS. 24, 26, 28, and 30 show contour lines of electric fields, and a highest-density electric field zone R is shown by parallel diagonal lines. Outward from the zone R, the electric field becomes lower gradually in density.

FIGS. 24, 26 of the invention examples A, B show that almost no electric field is generated around the plus signal terminal 13 by a flowing current in the minus signal terminal 14. On the contrary, FIGS. 28, 30 of the comparative examples A1, B1 show that a considerable electric field is generated around the plus signal terminal 103 or 106 by a flowing current in the minus signal terminal 104 or 107.

Thus, it was found that the invention examples A, B can limit generation of an induction current in the plus signal terminal 13 and the first ground terminal 15 when a flowing current in the minus signal terminal 14 generates an induction current in the second ground terminal 16. Accordingly, the invention examples A, B, and C can surely prevent a noise (current) generated in the plus and minus signal terminals 13, 14, limiting a signal transmission loss in the terminals.

Next, referring to FIGS. 31 to 37, a connector 31 of a third embodiment according to the present invention will be discussed. The same reference numeral is applied to the same component as that of the first and second embodiments and the component will not be discussed again.

Figure 31:
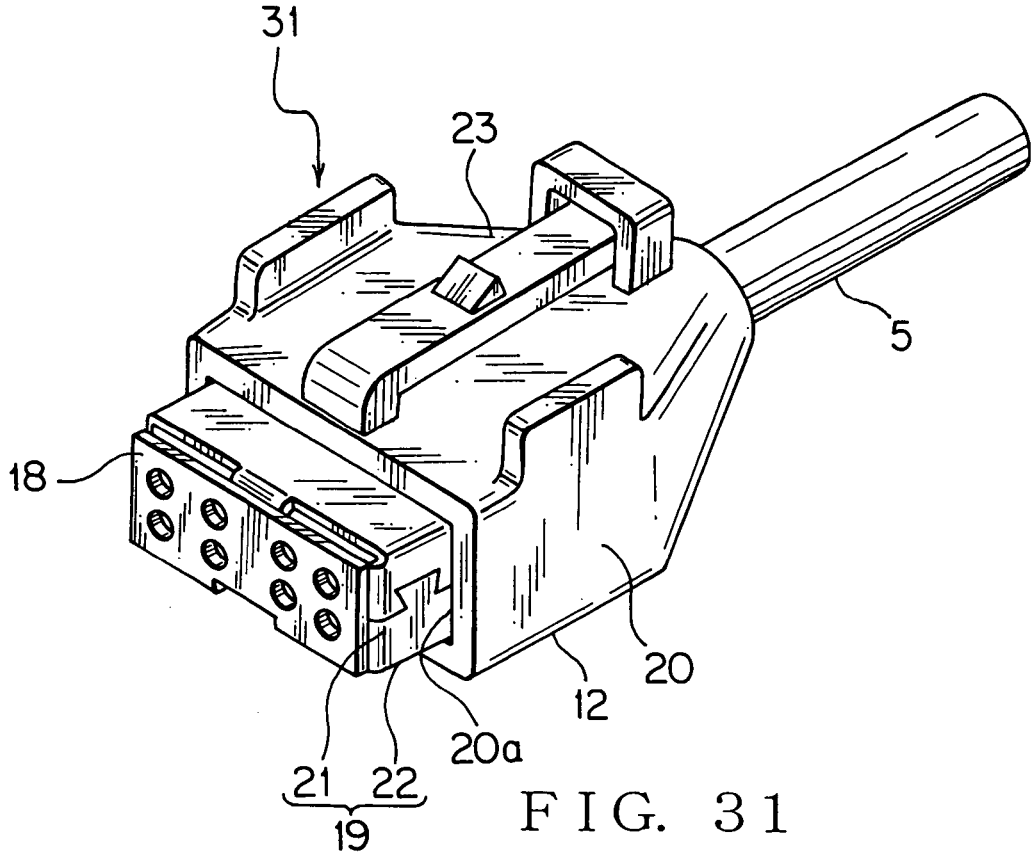
FIG. 31 is a perspective view showing a connector of a third embodiment according to the present invention for high-speed transmission of differential signals.
Figure 32:
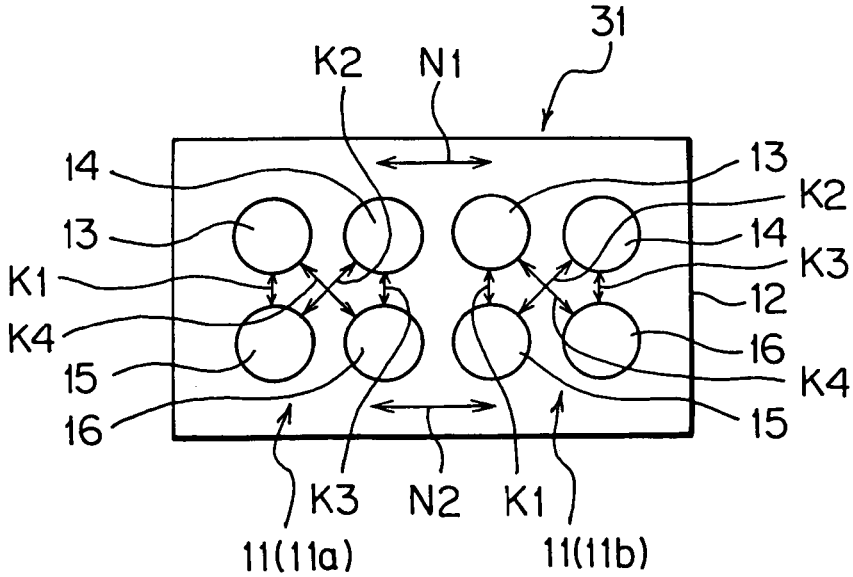
FIG. 32 is a schematic view showing arrangement of terminals of the connector of FIG. 31.

The connector 31 of the third embodiment, as shown in FIGS. 31 and 32, has a plurality of the terminal sets 11 discussed above. The third embodiment shown in the drawings has two of the terminal sets 11.

As shown in FIGS. 31 and 32, the signal terminals 13, 14 of the terminal sets 11 are positioned in a row along an arrow N1, while the ground terminals 15, 16 of the terminal sets 11 are positioned in a row along an arrow N2. Each of the terminals 13 to 16 in respect of each terminal set is positioned at each corner of a square.

The first ground terminal 15 and the second ground terminal 16 are provided in each terminal set of the third embodiment as well as the first and second embodiments. The first ground terminal 15 is positioned nearer to the plus signal terminal 13 than to the minus signal terminal 14, while the second ground terminal 16 is positioned nearer to the minus signal terminal 14 than to the plus signal terminal 13.

Thus, a current flow in the plus signal terminal 13 generates an induction current in the first ground terminal 15, and a current flow in the minus signal terminal 14 generates an induction current in the second ground terminal 16. The first ground terminal is positioned separated from the second ground terminal. Thereby, a current flow in the plus signal terminal 13 generates an induction current neither in the minus signal terminal 14 nor in the second ground terminal 16, while a current flow in the minus signal terminal 14 generates an induction current neither in the plus signal terminal 13 nor in the minus signal terminal 14.

Each of the plus signal terminal 13, the minus signal terminal 14, the first ground terminal 15, and the second ground terminal 16 is positioned at each corner of a square. This allows minimization of the connector. The provision of the plurality of terminal sets 11 increases transmitting signals in quantity.

Furthermore, the signal terminals 13, 14 of the terminal sets 11 are positioned in a row along arrow N1, while the ground terminals 15, 16 of the terminal sets 11 are positioned in a row along arrow N2. Thus, a flowing current in the terminal 13 or 14 generates an induction current in the corresponding ground terminal 15 or 16. The linear arrangement of the terminals allows minimization in size of the connectors.

Figure 33:
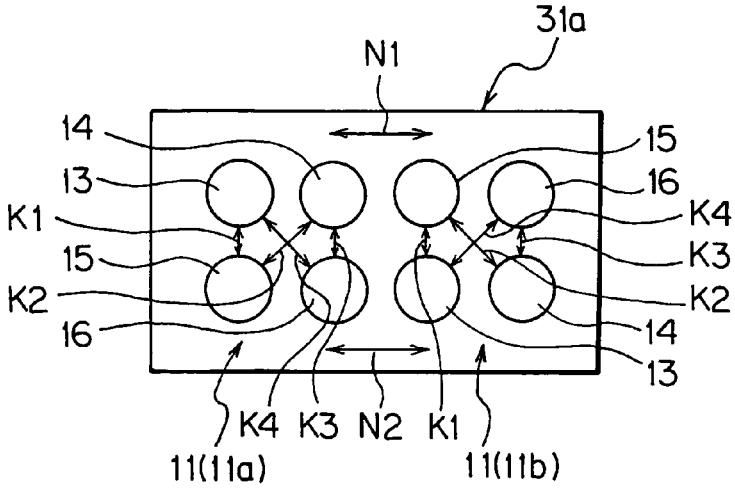
FIG. 33 is a schematic view showing a modified arrangement of terminals of the connector of FIG. 32.

In the third embodiment, as shown in a connector 31*a* of FIG. 33, the signal terminals 13, 14 of a set 11 may be positioned in line with the ground terminals 15, 16 of a next set 11. The same reference numeral is applied to a component the same as that of the connector 31 and the component will not be discussed again.

In FIG. 33, a terminal set 11*a* has the signal terminals 13, 14 which are along arrow N1 in line with the ground terminals 15, 16 of a next terminal set 11*b*. Meanwhile, the terminal set 11*a* has the ground terminals 15, 16 which are along arrow N2 in line with the signal terminals 13, 14 of the next terminal set 11*b*.

Thus, a current flow in the plus signal terminal 13 generates an induction current in the first ground terminal 15, and a current flow in the minus signal terminal 14 generates an induction current in the second ground terminal 16. The connector 31*a* can surely prevent a noise (current) generated in the plus and minus terminals 13, 14, limiting a signal transmission loss in the terminals. The connectors 31 and 31*a* of the third embodiment are also used for high-speed transmission of differential signals.

An associated connector (not shown) mating with the connector 31 or 31*a* has a plurality of terminal set arranged as corresponding to the terminal sets 11 of the connector 31 or 31*a*. The associated connector is fitted on a printed circuit board in the same way as the first and second embodiments.

The inventors of the present invention carried out a simulation to calculate operational effects of the connectors 31 and 31*a*. The simulation used a finite integration algorism to obtain an electric field of the connectors.

Figure 34:
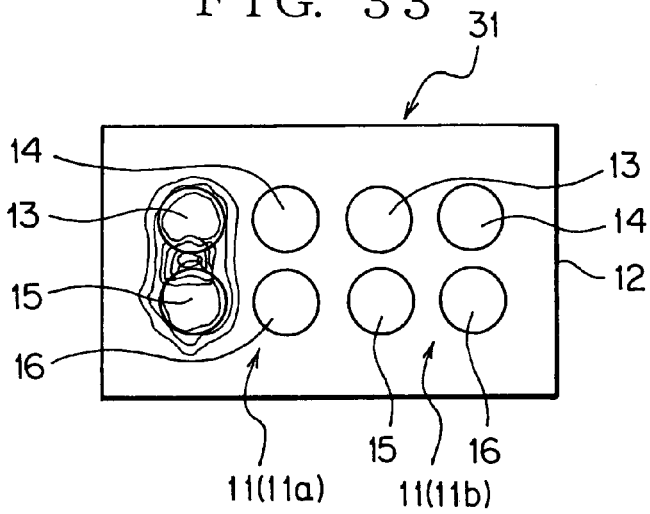
FIG. 34 is a schematic view showing an electric field obtained by a simulation due to a current flow in a plus signal terminal of a terminal set of the connector of FIG. 32.
Figure 35:
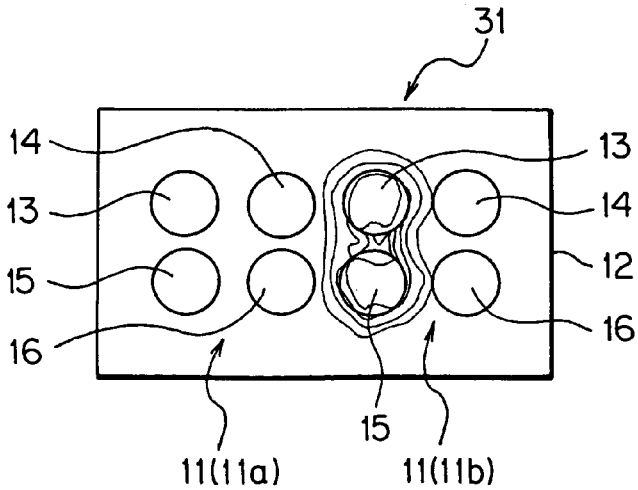
FIG. 35 is a schematic view showing an electric field obtained by a simulation due to a current flow in a plus signal terminal of another terminal set of the connector of FIG. 32.

In the connector 31 shown in FIG. 32, a current flow in the plus signal terminal 13 of the set 11*a* generates an electric field only around the corresponding ground terminal 15 as shown in FIG. 34. Likewise, a current flow in the plus signal terminal 13 of the next set 11*b* generates an electric field only around the corresponding ground terminal 15 as shown in FIG. 35. It was found that the current flow in the plus signal terminal 13 does not generate an electric field around the minus signal terminal 14.

Figure 36:
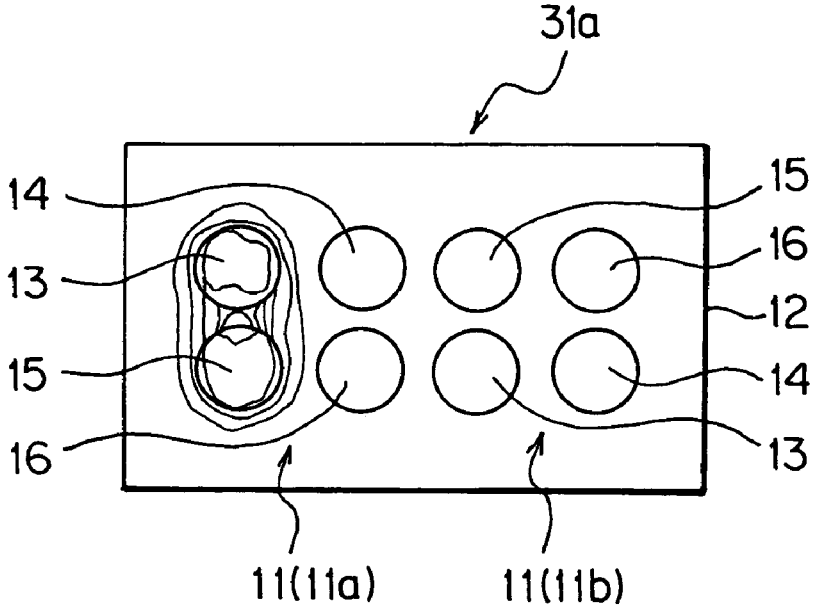
FIG. 36 is a schematic view showing an electric field obtained by a simulation due to a current flow in a plus signal terminal of a terminal set of the connector of FIG. 33.
Figure 37:
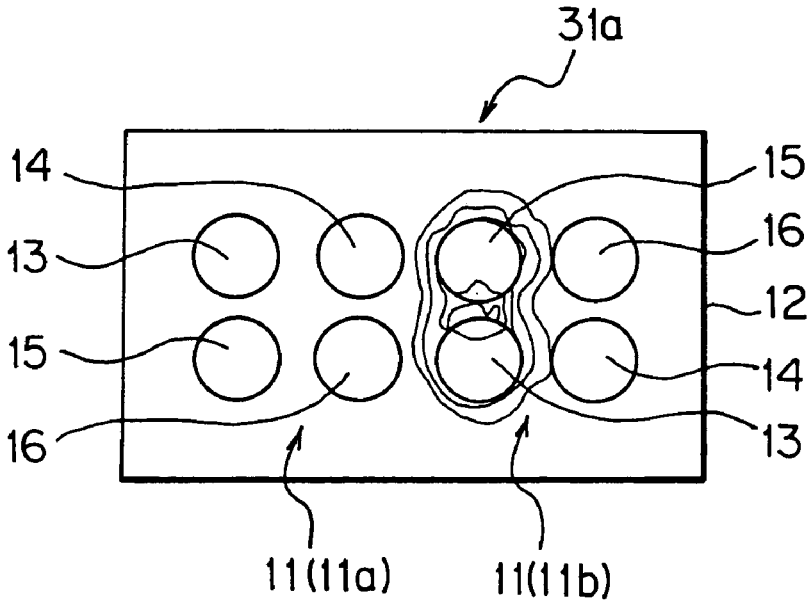
FIG. 37 is a schematic view showing an electric field obtained by a simulation due to a current flow in a plus signal terminal of another terminal set of the connector of FIG. 33.

In the connector 31*a* shown in FIG. 33, a current flow in the plus signal terminal 13 of the set 11*a* generates an electric field only around the corresponding ground terminal 15 as shown in FIG. 36. Likewise, a current flow in the plus signal terminal 13 of the next set 11*b* generates an electric field only around the corresponding ground terminal 15 as shown in FIG. 37. It was found that the current flow in the plus signal terminal 13 does not generate an electric field around the minus signal terminal 14.

From the result of the simulation, the terminal arrangement of connectors 31 or 31*a* was confirmed in that the connector 31 or 31*a* can surely prevent a noise (current) generated in the plus and minus terminals 13, 14, limiting a signal transmission loss in the terminals.

In the first to third embodiments, each of the terminals of each terminal set is positioned at each corner of a square or a rectangle. However, in the present invention, the terminals may be positioned respectively at each corner of another quadrangle. Furthermore, a distance between the terminals of the connectors of the first to third embodiments may be determined based on frequencies of transmitting signals and an impedance of the holder with the terminals.

In the third embodiment, the terminal sets 11 are arranged along arrow N1 or N2. However, in the present invention, the terminal sets 11 may be positioned in another pattern.

In the third embodiment, two terminal sets 11 are provided. However, in the present invention, more than two of the terminal sets 11 may be provided.

The terminals 13 to 16 and 48 to 51 may be configured in another form respectively.

The present invention is not limited in the discussed embodiments but is embodied in various configurations within the spirit of the invention.

What is claimed is:

1. An electrical connector comprising:

a terminal set essentially consisting of a plus signal terminal, a minus signal terminal, a first ground terminal, and a second ground terminal, each of the terminals including an electrical contact portion configured to electrically connect to a respective terminal of another electrical connector; and a connector housing accommodating the terminal set, wherein substantially entire portion of the terminals including the electrical contact portions are disposed inside the connector housing, and wherein each of the plus signal terminal, the minus signal terminal, the first ground terminal, and the second ground terminal has a cylindrical barrel made of electrically conductive metal.

2. The connector according to claim 1, wherein the terminals are arranged in a quadrangle with each of the terminals positioned at each corner of the quadrangle.

3. The connector according to claim 1, further comprising one or more terminal sets.

4. The connector according to claim 3, wherein the plus signal terminals and the minus signal terminals are positioned in a row, and the first ground terminal and the second ground terminal are positioned in another row.

5. The connector according to claim 3, wherein the plus and minus signal terminals of one of the terminal sets are positioned in a row with the first and second ground terminals of another terminal set.

6. The connector according to claim 1, wherein a distance between the plus signal terminal and the first ground terminal is shorter than a distance between the minus signal terminal and the first ground terminal, while a distance between the minus signal terminal and the second ground terminal is shorter than a distance between the plus signal terminal and the second ground terminal.

7. The connector according to claim 1, wherein the terminals are arranged in a row.

8. The connector according to claim 7, wherein the terminals are arranged sequentially in order of the first ground terminal, the plus signal terminal, the minus signal terminal, and the second ground terminal in the row.

9. The connector according to claim 1, wherein the first and second ground terminals are connected to a common earth line of an associated cable.

10. The connector according to claim 1, wherein the connector housing comprises a connecting member configured to connect to another electrical connector.

11. The connector according to claim 1, further comprising an inner housing configured to accommodate the terminal set, wherein the inner housing is removably disposed inside the connector housing.

12. The connector according to claim 1, wherein the plus signal terminal is electrically connected to a plus signal wire, the minus signal terminal is electrically connected to a minus signal wire, and both the first and second ground terminals are electrically connected to a ground wire.

13. The connector according to claim 1, wherein the plus and minus signal terminals are used for transmission of high-speed differential signals.

14. An electrical connector comprising:

a terminal set essentially consisting of a plus signal terminal, a minus signal terminal, a first ground terminal, and a second ground terminal, each of the terminals including an electrical contact portion configured to electrically connect to a respective terminal of another electrical connector; and a connector housing accommodating the terminal set, wherein substantially entire portion of the terminals including the electrical contact portions are disposed inside the connector housing, wherein the electrical contact portion is positioned at one end of the respective terminal, and the other end of the respective terminal includes another electrical contact portion configured to electrically connect to a circuit arranged in a printed circuit board, and wherein each of the plus signal terminal, the minus signal terminal, the first ground terminal, and the second ground terminal has a cylindrical barrel made of electrically conductive metal.

15. The connector according to claim 14, further comprising a retainer body disposed in the connector housing for retaining the terminals, an intermediate portion of each of the terminals between the two electrical contact portions being embedded in the retainer body.

16. The connector according to claim 15, wherein the retainer body comprises an insulating synthetic resin material.

* * * * *